US008599190B2

(12) United States Patent
Tsuchi

(10) Patent No.: US 8,599,190 B2
(45) Date of Patent: Dec. 3, 2013

(54) VOLTAGE LEVEL SELECTION CIRCUIT AND DISPLAY DRIVER

(75) Inventor: Hiroshi Tsuchi, Kanagawa (JP)

(73) Assignee: Renesas Electronics Corporation, Kawasaki, Kanagawa (JP)

( * ) Notice: Subject to any disclaimer, the term of this patent is extended or adjusted under 35 U.S.C. 154(b) by 433 days.

(21) Appl. No.: 13/074,768

(22) Filed: Mar. 29, 2011

(65) Prior Publication Data

US 2011/0242085 A1 Oct. 6, 2011

(30) Foreign Application Priority Data

Mar. 30, 2010 (JP) ..... 2010-077992

(51) Int. Cl.
*G09G 5/00* (2006.01)

(52) U.S. Cl.
USPC ..... 345/212; 327/75

(58) Field of Classification Search
USPC ..... 345/76, 77, 82, 83, 87, 88, 89, 94, 95, 345/211, 212; 327/74, 75
See application file for complete search history.

(56) References Cited

U.S. PATENT DOCUMENTS

| | | | | |
|---|---|---|---|---|
| 5,477,234 | A * | 12/1995 | Suzuki et al. | 345/95 |
| 5,982,349 | A * | 11/1999 | Yoon | 345/98 |
| 6,417,827 | B1 * | 7/2002 | Nagao et al. | 345/89 |
| 6,950,045 | B2 * | 9/2005 | Kim | 341/118 |
| 2002/0145600 | A1 * | 10/2002 | Morita | 345/211 |
| 2003/0142050 | A1 * | 7/2003 | Kim | 345/87 |
| 2007/0126689 | A1 * | 6/2007 | Ishii et al. | 345/100 |
| 2007/0237407 | A1 | 10/2007 | Hashido et al. | |
| 2007/0268225 | A1 * | 11/2007 | Woo et al. | 345/89 |
| 2009/0213051 | A1 * | 8/2009 | Tsuchi | 345/87 |
| 2009/0295767 | A1 * | 12/2009 | Tsuchi | 345/204 |
| 2011/0234571 | A1 * | 9/2011 | Tsuchi | 345/211 |

FOREIGN PATENT DOCUMENTS

JP 2007-279367 A 10/2007

* cited by examiner

*Primary Examiner* — Tom Sheng
(74) *Attorney, Agent, or Firm* — McGinn IP Law Group, PLLC

(57) ABSTRACT

A decoder includes a first sub-decoder that receives a first level voltage set and outputs voltages selected according to lower L-bits of N-bit data, a second sub-decoder that receives a second level voltage set and outputs voltages selected according to the lower L-bits, a third sub-decoder that selects, according to higher M-bits, one voltage from the voltages selected by the first and second sub-decoders, a fourth sub-decoder that outputs voltages selected according to lower P-bits from among a third level voltage set, a fifth sub-decoder that selects one voltage selected according to higher Q-bits from the voltages output from the fourth sub-decoder, and a sixth sub-decoder that controls conduction and non-conduction based on K-bits, between one output among outputs of the first sub-decoder, and one output among outputs of the fourth sub-decoder; output of the third sub-decoder and output of the fifth sub-decoder are connected to an output terminal; the first, second, and third sub-decoders are configured from transistor switches of said first polarity, and the fourth, fifth, and sixth sub-decoders are configured from transistor switches of said second polarity.

11 Claims, 12 Drawing Sheets

$P>L, M>Q\geqq 1$
$P+Q=L+M=N$
$K\geqq 1$ $P > L, M > Q \geqq 1$ $P + Q = L + M = N$ $K \geqq 1$

REFERENCE CASE

LCD ( Liquid-crystal Display )
DRIVER OUTPUT RANGE

REFERENCE CASE

OLED ( Organic light-emitting diode )
DISPLAY DRIVER OUTPUT RANGE

REFERENCE CASE

REFERENCE CASE

REFERENCE CASE

REFERENCE CASE

REFERENCE CASE

REFERENCE CASE

REFERENCE CASE

REFERENCE CASE

REFERENCE CASE

REFERENCE CASE

REFERENCE CASE

VOLTAGE LEVEL SELECTION CIRCUIT AND DISPLAY DRIVER

TECHNICAL FIELD

Reference to Related Application

This application is based upon and claims the benefit of the priority of Japanese patent application No. 2010-077992 filed on Mar. 30, 2010, the disclosure of which is incorporated herein in their entirety by reference thereto. The present invention relates to a level voltage selection circuit and data driver, and a display device using the same.

BACKGROUND

A liquid crystal display device (LCD), featured by thin thickness, light weight and low power consumption has recently come into widespread use, and is being predominantly employed as a display unit of mobile equipments, such as a portable telephone set (mobile phones or cellular phones), or a PDA (Personal Digital Assistants) or a notebook personal computer. In these days, with the progress in the technique for increasing a viewing area and for coping with moving images, the LCD display is now usable not only for mobile equipment but also for a stationary large screen display device and for a large screen size liquid crystal television set. A liquid crystal display device of an active matrix driving system is in use. As a thin type display device, a display device of the active matrix driving system employing an organic light emitting diode (OLED) also has been developed.

Referring to FIGS. 12A to 12C, a typical configuration of a thin type display device of the active matrix driving system (a liquid crystal display device and an organic light emitting diode display device) will be briefly described. FIG. 12A is a block diagram showing essential portions of the thin type display device. FIG. 12B is a schematic view showing essential portions of a unit pixel of a display device panel of a liquid crystal display device. FIG. 12C is a schematic view showing essential portions of a unit pixel of a display device panel of an organic light emitting diode display device. In FIGS. 12B and 12C, a unit pixel is schematically shown as an equivalent circuit.

Referring to FIG. 12A, the thin type display device of the active matrix driving system includes, as its typical components, a power supply circuit 940, a display controller 950, a display panel 960, a gate driver 970 and a data driver 980. The display device panel 960 includes a matrix array of unit pixels each comprising a pixel switch 964 and a display element 963. In the case of a color SXGA (Super eXtended Graphics Array) panel, for example, the matrix array is made up by 1280×3 pixel columns and 1024 pixel rows. On the display device panel 960, a plurality of scan lines 961 that transmit scan signals output from the gate driver 970 to the respective unit pixels and a plurality of data lines 962 that transmit gray scale voltage signals output from the data driver 980 are arrayed in a lattice-shaped configuration. The gate driver 970 and the data driver 980 are supplied with a clock signal CLK and control signals under control by the display device controller 950. Image data are supplied to the data driver 980. Nowadays, image data are predominantly digital data. A power supply circuit 940 supplies necessary power supply voltages to the gate driver 970 and the data driver 980. The display device panel 960 includes a semiconductor substrate. As the display device panel 960 for a large display device, a semiconductor substrate formed by an insulating substrate, having a plurality of thin film transistors (pixel switches) formed thereon, has been widely used.

In the display device of FIG. 12A, the pixel switch 964 is turned on (made electrically conductive) and off by a scan signal and a gray scale level voltage signal, corresponding to pixel data, is applied to the display device element 963. The display device element 963 then is changed in luminance in response to the gray scale voltage signal, thus displaying an image. Each image equivalent data is re-written in each frame period, which is usually ca. 0.017 sec, for 60 Hz driving. Each scan line 961 sequentially selects pixel rows (lines) to turn on the pixel switches 964. During the time the pixel rows are selected, the gray scale voltage signals are supplied from the data lines 962 via the pixel switches 964 to the display device elements 963. There are cases where a plurality of pixels is simultaneously selected by scan lines or the driving is performed by a frame frequency higher than 60 Hz.

Referring to FIGS. 12A and 12B, a liquid crystal display device has a display panel 960 including a semiconductor substrate and an opposite substrate. The semiconductor substrate has a matrix array of pixel switches 964, as a unit pixel, and transparent electrodes 973. The opposite substrate has a single transparent electrode 974 extending on its entire surface. These substrates are mounted facing each other with a gap, in which a liquid crystal material is sealed. The display element 963, forming a unit pixel, includes a pixel electrode 973, an opposite substrate electrode 974, a liquid crystal capacitance 971 and an auxiliary capacitance 972. A backlight is provided as a light source on a back side of the display device panel.

When the pixel switch 964 is turned on by a scan signal from the scan line 961, the gray scale voltage signal from the data line 962 is applied to the pixel electrode 973. The transmittance of the backlight, transmitted through the liquid crystal, is changed due to the potential difference between each pixel electrode 973 and the opposite substrate 974. The potential difference is held by the liquid crystal capacitance 971 and by the auxiliary capacitance 972, for a specified time, even after the pixel witch 964 is turned off, thus providing for display. In driving the liquid crystal display device, the voltage polarity is reversed between plus and minus polarities, with respect to the common voltage of the opposite electrode 974, usually every frame period (inverted driving), in order to prevent deterioration of liquid crystal. Hence, the data line 962 is also driven by dot inversion driving or column inversion driving. The dot inversion driving is a driving method in which a voltage polarity applied to the liquid crystal is changed in every pixel, whereas the column inversion driving is a driving method in which the voltage polarity is changed in every frame.

In the organic light emitting diode display device, shown in FIGS. 12A and 12C, the display device panel 960 includes a semiconductor substrate on which a matrix array of a plurality of unit pixels are arranged. Each of these unit pixels comprises a pixel switch 964, an organic light emitting diode 982 and a thin film transistor (TFT) 981. The organic light emitting diode is formed by an organic film sandwiched between two thin film electrode layers. The TFT 981 controls a current supplied to the organic light emitting diode 982. The organic light emitting diode 982 and the TFT 981 are connected in series with each other between power supply terminals 984 and 985 supplied with different power supply voltages. An auxiliary capacitance 983 holds a control terminal voltage of the TFT 981. The display device element 963, associated with a pixel, includes the TFT 981, organic light emitting diode 982, power supply terminals 984, 985 and the auxiliary capacitance 983.

When the pixel switch 964 is turned on (made electrically conductive) by the scan signal from the scan line 961, the gray scale voltage signal from the data line 962 is applied to the control terminal of the TFT 981. This causes light to be emitted from the organic light emitting diode 982 with the luminance corresponding to the current controlled by TFT 981 to make necessary display. Light emission is sustained even after the pixel switch 964 is turned off (made electrically non-conductive), since the gray scale voltage signal applied to the control terminal of the TFT 981 is kept for a certain time by the auxiliary capacitance 983. In FIG. 30C, the pixel switch 964 and the TFT 981 formed by n-channel transistors are shown as an example. The TFT 981 may, however, be formed by a p-channel transistor. An organic light emitting diode may also be connected to the side the power supply terminal 984. In the driving of the organic light emitting diode display device, no inverted driving, such as is used in the liquid crystal display device, need be used.

The above describes the configuration of an organic light emitting diode display device in which display is made in association with a gray scale voltage signal applied to a device element from the data line 962, but there is another configuration in which the display device receives a gray scale current signal output from the data driver to make display. However, the description of the present invention will be made only with reference to the configuration in which the display device receives a gray scale voltage output from the data driver to make display.

Referring to FIG. 12A, it suffices that the gate driver 970 is adapted to supply a scan signal which is at least a binary signal. On the other hand, the data driver 980 has to drive each data line 962 with multi-level gray scale voltage signals matched to the number of gray scales. Therefore, the data driver 980 includes a digital to analog converter (DAC) circuit that includes a decoder which converts image data into a gray scale voltage signal and an amplifier which amplifies and outputs the gray scale voltage signal to the data line 962.

For high-end use mobile equipments, notebook PCs, monitors or TV receivers, having thin type display devices, such as liquid crystal display devices or organic light emitting diode display devices, the tendency is towards a high image quality or a multiple colors and the demand for multi-bit video digital data is increasing. Multi-bit DAC area is dependent on the decoder configuration.

Furthermore, in the liquid crystal display device, there is a demand for lowering of a power supply voltage used to drive a liquid crystal. On the other hand, in the OLED (organic light emitting diode) display device, polarity inversion as in liquid crystal driving is not necessary, and its dynamic range is wide for a given power supply voltage. In order to realize these, in both the liquid crystal display device and the organic light emitting diode display device, in the data driver 980, as switches of a level voltage selection circuit (decoder), a configuration is necessary in which a Pch transistor switch (Pch-SW) and an Nch transistor switch (Nch-SW) are combined, (a CMOS switch configuration wherein the Pch-SW and Nch-SW are connected in parallel, in order for currents between drain and source of the Pch-SW and Nch-SW to flow in the same direction, and have respective gates supplied with normal and complementary control signals to be controlled in common to be tuned on and off).

However, use of the CMOS switch increases the decoder area and driver cost.

It is to be noted that Patent Document 1 discloses a configuration in which, in a decoder circuit that decodes multi-bit digital data and outputs an electrical signal (voltage) corresponding to the multi-bit digital data, as a configuration where size is reduced in a longitudinal direction in which output candidate reference voltages are arrayed, without increasing size in a lateral direction, there is provided a plurality of first stage sub-decoder circuits (FSD0-FSD31) arranged for a plurality of adjacently disposed output candidates (V0-V63), each including unit decoders (SWE, SWO) disposed in parallel in a direction perpendicular to an array direction of the output candidates. In the disclosure of Patent Document 1, the size in the longitudinal direction of the decoder is reduced, but problems and ways for solving the problems are completely different from the present disclosure.

[Patent Document 1] JP Patent Kokai Publication No. JP-P2007-279367A

SUMMARY

The following is an analysis of the related technologies.

The following described an output range of a driver with reference to FIG. 6. It is to be noted that FIG. 6 is a diagram made by the present inventor in order to describe a problem of reference technology. FIG. 6A represents an output range of an LCD driver. The LCD driver performs polarity inversion driving for a positive polarity and a negative polarity, with regard to a common electrode voltage COM. A positive polarity voltage range and a negative polarity voltage range are respectively located in a high potential side and a low potential side, but when taking an adjustment width Vdif1 of the common electrode voltage into account, each voltage range is required to be able to output a wider range than (½)×(VDD−VSS) (VSS is generally ground potential=0V).

FIG. 6B represents an output range of an OLED driver for active matrix driving (voltage programming type). The OLED driver does not have polarity inversion driving as in LCD. FIG. 6B shows an example in which an output range is (VSS+Vdif2) to VDD. The potential difference Vdif2 is provided for a potential difference between electrodes necessary for light emission of an OLED element formed in a display panel, or a threshold voltage of a transistor on the display panel that controls a current supplied to the OLED element.

In FIGS. 6A and 6B, a wide output range for power supply voltage is required in each driver. For this reason, in each driver, in response to a data signal (digital video signal), a wide output voltage range is required also for a decoder that selects voltage of a level corresponding to the output voltage. In the decoder, the level voltage (reference voltage) of a high potential side (VDD side) can be selected by a Pch transistor switch (Pch-SW), but with the Pch-SW that selects a level voltage of a low potential side (VSS side), since a threshold voltage (its absolute value) increases due to a substrate bias effect, and a gate-to-source voltage Vgs (absolute value) of the Pch transistor also decreases, ON resistance may increase (current driving capability decreases). Therefore, there may be cases wherein the decoder cannot select and output a level voltage of the low potential side (VSS side).

For this reason, in the decoder, it is necessary to enlarge transistor size (gate width W) of the Pch-SW that selects the level voltage of the low potential side (VSS side), or to combine the Pch-SW that selects the level voltage of the low potential side (VSS side) and an Nch transistor switch (Nch-SW). For this reason, the area of the decoder increases significantly.

FIG. 7A and FIG. 7B are diagrams showing a received reference voltage (level voltage) and a selected output voltage of standard sized Pch-SW and Nch-SW forming the decoder. FIGS. 7C and 7D are diagrams showing, relationships between an average selected voltage and an average ON resistance (characteristics 71 and 72), for one transistor of the Pch-SW and Nch-SW. The horizontal axis is a selected voltage (output voltage of a switch) and the vertical axis is an ON resistance value of a transistor switch. It is to be noted that FIG. 7 is a diagram made by the present inventor in order to describe problems of the reference technology.

In FIG. 7C, a range (a-1) of from Vpa to VDD represents a voltage range that can be selected at a sufficient operation speed by the Pch-SWs only. When a gate potential of the Pch-SWs is a Low potential (VSS), and the selected voltage is at a high potential (therefore, when the received reference voltage is VDD to Vpa), the absolute value of the gate-to-source voltage Vgs becomes large, and the ON resistance value is small. It is to be noted that in FIG. 7C, Ro of the vertical axis represents an allowable upper limit of the ON resistance of the Pch-SW in consideration of an output delay of the selected voltage.

In FIG. 7C, as shown in the ON resistance characteristic 71, a range (a-2) of from Vpb to Vpa can be selected by the Pch-SW, but represents a voltage range in which the ON resistance is high and operating speed is inadequate. It is necessary to combine the Pch-SW and Nch-SW to make a CMOS circuit, or to make a gate width (W) of the Pch-SW sufficiently larger than standard size to lower the ON resistance thereof.

In FIG. 7C, a range (a-3) of VSS to Vpb represents a voltage range in which a selected voltage cannot be output by the Pch-SW only, and hence it is necessary to combine the Pch-SW with Nch-SW to make a CMOS switch.

Next, in FIG. 7D, as shown in the ON resistance characteristic 72, a range (b-1) of from VSS to Vna represents a voltage range in which selection is possible at a sufficient operation speed by the Nch-SWs only. When a gate potential of the Nch-SW is at a High potential (VDD), and the selected voltage is at a low potential, (when the received reference voltage is VSS to Vna), the absolute value of the gate-to-source voltage Vgs becomes large, and the ON resistance value is small. In FIG. 7D, Ro of the vertical axis represents an allowable upper limit of the ON resistance of the Nch-SW in consideration of an output delay of the selected voltage.

In FIG. 7D, a range (b-2) of from Vnb to Vna can be selected by the Nch-SW, but represents a voltage range in which the ON resistance is high and the operation speed is inadequate. It is necessary to combine the N-ch Sw and a Pch-SW to make a CMOS switch, or make the gate width (W) of the Nch-SW sufficiently larger than standard size to lower the ON resistance thereof.

In FIG. 7D, a range (b-3) of from Vnb to VDD represents a voltage range that cannot be selected by the Nch-SW only, and hence it is necessary to combine the Nch-SW with a P-ch SW to make a CMOS switch.

FIG. 8 is a diagram showing an example of a decoder corresponding to the OLED, or a positive decoder corresponding to a positive polarity output range of the LCD. FIG. 8 is a diagram made by the present inventor in order to describe problems of the reference technology.

Referring to FIG. 8, a range of 32 levels (V1 to V32) is used as an output range of the decoder. V1 is a low potential side and V32 is a high potential side. The upper half of V17 to V32 is a region in which it is possible to configure a circuit that receives V17 to V32 for selection by Pch-SWs alone (the ON resistance of the Pch-SW is small, and the absolute value of the gate-to-source voltage Vgs is large).

V9 to V16 is a region in which it is possible to configure a circuit that receives V9 to V16 for selection by Pch-SWs alone (the ON resistance of the Pch-SW may be just small, and the absolute value of the gate-to-source voltage Vgs may be just large), and an increase in the gate width (W) of the Pch-SW is necessary.

V1 to V8 is a region in which it is not possible to configure a circuit that receives V1 to V8 for selection by Pch-SWs alone, and combination of P-ch SWs and Nch-SWs is necessary.

FIG. 9 is a diagram schematically showing a typical configuration example of the data driver (LSI chip) 980. FIG. 9 shows an OLED circuit block, or a circuit block for one of a positive polarity or negative polarity of an LCD. FIG. 9 is a diagram made by the present inventor in order to describe a problem of reference technology.

Referring to FIG. 9, there are provided a level voltage generation circuit 704 (reference voltage generation circuit) that outputs a plurality of level voltages, decoders 705-1 to 705-*q* corresponding to the number of outputs q, and amplifier circuits (output circuits) 706-1 to 706-*q*. Outputs S1 to Sq of the data drivers are extracted from a long side edge of the chip. The more outputs, the longer the long side of the chip is.

The plurality of level voltages (reference voltages) output from the level voltage generation circuit 704 are supplied in common to the decoders 705-1 to 705-*q*, and a plurality of level voltage lines are arranged along a long side of the LSI chip (data driver) 980. Digital data signals are respectively supplied to the decoders 705-1 to 705-*q* arranged in correspondence with the respective outputs S1 to Sq. Respective bit lines forming a digital data signal are arranged in parallel to a short side direction of the chip 980. For each of the decoders 705-1 to 705-*q*, a Pch device region 705P configured by Pch-SWs alone, and an Nch device region 705N configured by Nch-SWs alone, are disposed upper and lower sides (sequence is arbitrary) in the diagram, with respect to the short side direction. This is because, in a silicon LSI, a Pch device and an Nch device are formed inside an N well and a P well that are mutually different; isolation distance between elements inside the same well is small, but isolation distance between devices in different wells is large.

Therefore, by arranging the Pch device region 705P and the Nch device region 705N in upper and lower sides in the short side direction, rather than arranging the Pch device region 705P and the Nch device region 705N alternately in the long side direction, element spacing between outputs of the decoders 705-1 to 705-*q* is small, so that it is possible to reduce the pitch (output interval) of the outputs S1, S2, . . . Sq, and as a result it is possible to reduce the area of the LSI chip 980.

Each of the decoders 705-1 to 705-*q*, which are arranged on the right side of the chip, has a layout configuration such that a plurality of level voltages (reference voltages) output from the level voltage generation circuit 704 are supplied to a decoder left end side in FIG. 9, selection is made by switches in the Pch device region 705P and the Nch device region 705N, and for example, a level voltage selected from an output terminal of a decoder is output, but (refer to FIG. 10 and FIG. 11 described later), a voltage output from the decoder right end side is supplied to an amplifier circuit arranged on a lower side of the decoder by wiring. In FIG. 9, a configuration is possible in which a decoder and an amplifier are provided on a left side of the level voltage generation circuit 704, and a plurality of level voltages output from the level voltage generation circuit 704 are supplied to the decoder right side.

FIG. 10 is a diagram showing a configuration of a decoder with one output of reference technology (comparative example of the present invention described later). FIG. 10 is a diagram made by the present inventor in order to describe problems of the reference technology. With regard to the decoder, FIG. 10 is a diagram showing a configuration example of a comparative example (reference example) in which each switch that selects a level voltage V1 to V8 on a VSS side in FIG. 8 is configured by a CMOS switch. In FIG. 10, a transistor switch (noted by an X inside an O) in a range shown by Pch-SW is formed in a Pch device region 705P in FIG. 9, and a transistor switch (noted by an X inside an O) in a range shown by Nch-SW is formed in an Nch device region 705N of FIG. 9.

In FIG. 10, a group of switches of a range shown by Pch-SW forms a decoder that selects and outputs, in a tournament manner, one of a level voltage set V1 to V32 to an output OUT, and is provided with 32+16+8+4+2=62 of the Pch-SWs. That is, 16 voltages are selected from among 32 voltages by 16 Pch-SWs that are turned ON (conductive) in accordance with the first bit, which is the least significant bit, or its complementary bit (D0, D0B), 8 voltages are selected from among 16 voltages by 8 Pch-SWs that are turned ON (conductive) in accordance with the second bit or its complementary bit (D1, D1B), 4 voltages are selected from among 8 voltages by 4 Pch-SWs that are turned ON (conductive) in accordance with the third bit or its complementary bit (D2, D2B), 2 voltages are selected from among 4 voltages by 2 Pch-SWs that are turned ON (conductive) in accordance with the fourth bit or its complementary bit (D3, D3B), and one voltage is selected from among 2 voltages by one Pch-SWs that is turned ON (conductive) in accordance with the fifth bit or its complementary bit (D4, D4B). It is noted that a symbol "B" in each of "D0B" to "D4B" indicates a "Bar" such that D0B, for example, may be termed as a bar signal (complementary signal) of D0, which may be termed as a normal signal or a true signal.

The Pch-SWs 1 to 16 that select the level voltage set V1 to V8 form respectively CMOS switches with the corresponding Nch-SWs 1 to 16. In FIG. 10, a notation in which a Pch-SW and Nch-SW forming one CMOS switch have the same reference number is used.

Referring to FIG. 10, there are provided: four Pch-SWs 1, 3, 5, and 7, having diffusion layers (sources) respectively connected to V1, V3, V5, and V7, and gates connected in common to a data signal (the least significant bit) D0, and four Nch-SWs 1, 3, 5, and 7, having other diffusion layers (drains) connected to V1, V3, V5, and V7, and gates connected in common to D0B (complementary signal of D0).

There are provided: four Pch-SWs 2, 4, 6 and 8 having diffusion layer (sources) respectively connected to V2, V4, V6 and V8, and gates connected in common to D0B, and four Nch-SWs 2, 4, 6 and 8 having diffusion layers (drains) respectively connected to V2, V4, V6 and V8, and gates connected in common to D0.

Other diffusion layers (sources) of the Nch-SWs 1 and 2 are coupled together and are connected via wiring between Pch/Nch regions to the coupled other diffusion layers (drains) of the Pch-SWs 1 and 2. The coupled other diffusion layers (sources) of the Nch-SWs 1 and 2 are connected to one diffusion layer (drain) of the Nch-SW 9 that has a gate connected to D1B.

Other diffusion layers (sources) of the Nch-SWs 3 and 4 are coupled together and are connected via wiring between Pch/Nch regions to coupled other diffusion layers (drains) of the Pch-SWs 3 and 4. The coupled other diffusion layers (sources) of the Nch-SWs 3 and 4 are connected to one diffusion layer (drain) of the Nch-SW 10 that has a gate connected to a data signal D1.

Other diffusion layers (sources) of the Nch-SWs 5 and 6 are coupled together and are connected via wiring between Pch/Nch regions to coupled other diffusion layers (drains) of the Pch-SWs 5 and 6. The coupled other diffusion layers (sources) of the Nch-SWs 5 and 6 are connected to one diffusion layer (drain) of the Nch-SW 11 that has a gate connected to D1B.

Other diffusion layers (sources) of the Nch-SWs 7 and 8 are coupled together and are connected via wiring between Pch/Nch regions to coupled other diffusion layers (drains) of the Pch-SWs 7 and 8. The coupled other diffusion layers (sources) of the Nch-SWs 7 and 8 are connected to one diffusion layer (drain) of the Nch-SW 12 that has a gate connected to D1.

Coupled other diffusion layers (drains) of the Pch-SWs 1 and 2 are connected to one diffusion layer (source) of the Pch-SW 9 that has a gate connected to D1.

Coupled other diffusion layers (drains) of the Pch-SWs 3 and 4 are connected to one diffusion layer (source) of the Pch-SW 10 that has a gate connected to D1B.

Coupled other diffusion layers (drains) of the Pch-SWs 5 and 6 are connected to one diffusion layer (source) of the Pch-SW 11 that has a gate connected to D1.

Coupled other diffusion layers (drains) of the Pch-SWs 7 and 8 are connected to one diffusion layer (source) of the Pch-SW 12 that has a gate connected to D1B.

Other diffusion layers (sources) of the Nch-SWs 9 and 10 are coupled together and are connected via wiring between Pch/Nch device regions to coupled other diffusion layers (drains) of the Pch-SWs 9 and 10. The coupled other diffusion layers (sources) of the Nch-SWs 9 and 10 are connected to one diffusion layer (drain) of the Nch-SW 13 that has a gate connected to a data signal D2B.

Coupled other diffusion layers (sources) of the Nch-SWs 11 and are connected via wiring between Pch/Nch device regions to coupled other diffusion layers (drains) of the Pch-SWs 11 and 12. The coupled other diffusion layers (sources) of the Nch-SWs 11 and 12 are connected to one diffusion layer (drain) of the Nch-SW 14 that has a gate connected to a data signal D2.

Coupled other diffusion layers (drains) of the Pch-SWs 9 and 10 are connected to one diffusion layer (source) of the Pch-SW 13 that has a gate connected to the data signal D2.

Coupled other diffusion layers (drains) of the Pch-SWs 11 and 12 are connected to one diffusion layer (source) of the Pch-SW 14 that has a gate connected to D2B.

Coupled other diffusion layers (sources) of the Nch-SWs 13 and 14 are connected via wiring between Pch/Nch device regions to coupled other diffusion layers (drains) of the Pch-SWs 13 and 14.

The coupled other diffusion layers (sources) of the Nch-SWs 13 and 14 are connected to one diffusion layer (drain) of the Nch-SW 15 that has a gate connected to a data signal D3B.

The coupled other diffusion layers (drains) of the Pch-SWs 13 and 14 are connected to one diffusion layer (drain) of the Pch-SW 15 that has a gate connected to the data signal D3.

The other diffusion layer (source) of the Nch-SW 15 is connected to the other diffusion layer (drain) of the Pch-SW 15 via wiring between Pch/Nch device regions, and is connected to one diffusion layer (drain) of the Nch-SW 16 that has a gate connected to a data signal D4B inside an Nch device region.

The other diffusion layer (drain) of the Pch-SW 15 is connected to one diffusion layer (source) of the Pch-SW 16 that has a gate connected to the data signal D4. The other diffusion layer (source) of the Nch-SW 16 and the other diffusion layer (drain) of the Pch-SW 16 are connected in common to an output terminal OUT. The Nch-SWs 1 to 16 corresponding to the Pch-SWs 1 to 16 respectively form equivalent CMOS switches.

According to the analysis made for the reference technology (comparative example) shown FIG. 10, since switches that select level voltages V1 to V8, based on the data signals D0 (D0B) to D4 (D4B) form a CMOS configuration, ON resistance of these switches is low, but wiring between Pch/Nch device regions increases, and wiring area increases. For example, in the comparative example shown in FIG. 10, as wiring between the Pch/Nch device regions needed for CMOS connections, separate from wiring area for the data signals D0 (D0B) to D4 (D4B), it is necessary to prepare wiring area for four lines (11-14) between D0 and D1B, for two lines (15,16) between D1 and D2B, for one line (17) between D2 and D3B, and for one line (18) between D3 and D4B. For this reason, pitch between bit lines increases and decoder area increases. Furthermore, lateral size of the decoder in FIG. 9 increases, and pitch between output S1 to Sq increases.

In addition, as described with reference to FIG. 8, with regard to reference voltages V9 to V16 selected by Pch-SWs alone that do not form a CMOS, in order to decrease the ON resistance, it is necessary to increase gate size (gate width W) of the Pch-SWs.

FIG. 11 is a diagram showing a configuration of reference technology (another comparative example) that differs from the reference technology of FIG. 10. As with FIG. 10, FIG. 11 is also a diagram made by the present inventor in order to describe a problem of the reference technology. As shown in FIG. 11, respective lines for level voltages V1 to V8 are provided for each Pch/Nch device region, and V1 to V8 are respectively selected by Pch-SWs and Nch-SWs. In FIG. 11, with regard to Pch-SWs 1 to 16 and Nch-SWs 1 to 16, Pch-SW and Nch-SW having the same number compose a CMOS switch.

According to the reference technology shown in FIG. 11, there is no wiring between the Pch/Nch device regions, as in FIG. 10 in which wiring 11 to 18 between the Pch/Nch device regions are provided. In the configuration of FIG. 11, level voltage lines (V1 to V8) increase for Nch-SW regions, but by wiring these level voltage lines (V1 to V8) in the Nch device regions, the area does not increase.

However, in the reference technology shown in FIG. 11, the ON resistance of the Pch-SWs that select the level voltages V9 to V16 is high, and an increase in the gate width (W) of these Pch-SWs is necessary.

Accordingly, it is an object of the present invention to provide a decoder that performs selection from a plurality of level voltages in accordance with digital data, and that is able to suppress an increase in the number of additional transistors and an increase in Pch/Nch wiring connections, and also to provide a data driver having this decoder.

The present invention may be outlined as follows, though not limited thereto.

According to an aspect of the present invention, there is provided a level voltage selection circuit that selects one level voltage from among a plurality of level voltages, based on an N-bit digital signal, where N is an integer greater than or equal to 2, to output a selected level voltage from an output terminal thereof. The plurality of level voltages including:

a first level voltage set;

a second level voltage set; and a third level voltage set, respective voltage ranges of said first level voltage set and said second level voltage set not mutually overlapping, and said third level voltage set and said second level voltage set including one or a plurality of level voltages in common.

The level voltage selection circuit comprises: a first sub-decoder that receives said first level voltage set, said first sub-decoder including a plurality of switches controlled to be conductive or non-conductive based on a predetermined lower L-bit signal of said N-bit digital signal to select a first number of level voltages from said first level voltage set received, said first sub-decoder including a plurality of output ends, the number of which is the same as said first number and which output said first number of level voltages selected by said plurality of switches included in said first sub-decoder;

a second sub-decoder that receives said second level voltage set, said second sub-decoder including a plurality of switches controlled to be conductive or non-conductive based on said L-bit signal of said N-bit digital signal to select a second number of level voltages from said second level voltage set received, said second sub-decoder including a plurality of output ends, the number of which is the same as said second number and which output said second number of level voltages selected by said plurality of switches included in said second sub-decoder;

a third sub-decoder that receives a plurality of level voltages output from said first and said second sub-decoders, the number of said plurality of level voltages received being a sum of said first number and said second number, said third sub-decoder including a plurality of switches controlled to be conductive or non-conductive based on a predetermined higher M-bit signal of said N-bit digital signal, to select one level voltage from said plurality of level voltages received, the number thereof being a sum of said first number and said second number, output from said first and said second sub-decoders, said third sub-decoder outputting said one level voltage selected by said plurality of switches included in said third sub-decoder to said output terminal;

a fourth sub-decoder that receives said third level voltage set, said fourth sub-decoder including a plurality of switches controlled to be conductive or non-conductive based on a predetermined lower P-bit signal of said N-bit digital signal to select a third number of level voltages from said third level voltage set received, said fourth sub-decoder including a plurality of output ends, the number of which is the same as said third number and which output said third number of level voltages selected by said plurality of switches included in said fourth sub-decoder;

a fifth sub-decoder that receives said third number of level voltages output from said third number of output ends of said fourth sub-decoder, said fifth sub-decoder including a plurality of switches controlled to be conductive or non-conductive based on a predetermined higher Q-bit signal of said N-bit digital signal to select one level voltage from among said third number of level voltages output from said third number of output ends of said fourth sub-decoder, said fifth sub-decoder outputting said one level voltage selected by said plurality of switches included in said fifth sub-decoder to said output terminal, and a sixth sub-decoder that includes at least one switch, said one switch controlling connection between one output end among said first number of output ends of said first sub-decoder and one output end among said third number of output ends of said fourth sub-decoder, to be conductive or non-conductive based on a predetermined K-bit signal of said N-bit digital signal, said one switch, when conductive, outputting a level voltage output from said one output end of said first sub-decoder, to said one output end of said fourth sub-decoder.

The respective switches of said first to third sub-decoders includes transistors of a first polarity.

The respective switches of said fourth to sixth sub-decoders includes transistors of a second polarity.

N, L, M, P, Q, and K, each being a positive integer, are set to satisfy the following relationships:

P is greater than L;

L is less than N and greater than or equal to 11

M is greater than Q, and Q is greater than or equal to 1;

a sum of P and Q is equal to N, and a sum of L and M is equal to N, and

K is greater than or equal to 1.

The present invention provides a data driver having the level voltage selection circuit and provides a display device having the data driver.

According to the present invention, there are provided a decoder, data driver, and display device, which are able to suppress an increase in the number of additional transistors, to suppress an increase in inter-Pch/Nch wiring connections, and to suppress an increase in area. According to the present invention, it is possible to suppress an increase in gate width of switches near a boundary of a switch group where Pch-SWs and Nch-SWs are combined to form a CMOS.

Still other features and advantages of the present invention will become readily apparent to those skilled in this art from the following detailed description in conjunction with the accompanying drawings wherein only exemplary embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTIONS OF THE DRAWINGS

PREFERRED MODES

Figure 1:
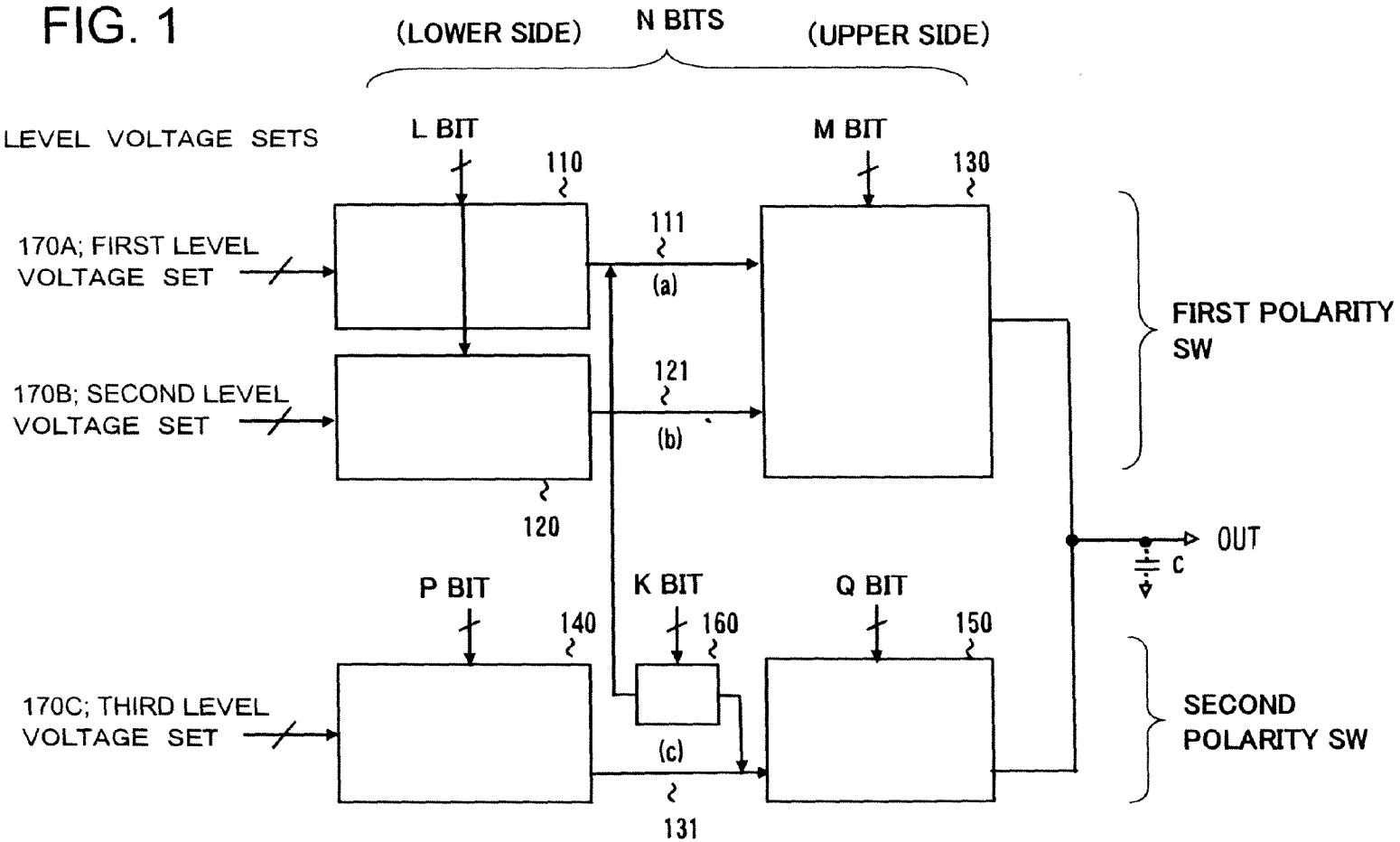
FIG. 1 is a diagram showing a configuration of one of modes of the present invention.

The following describes preferred modes of the present invention. FIG. 1 is a diagram showing a configuration of one of exemplary embodiments. Referring to FIG. 1, a decoder circuit (level voltage selection circuit), that selects and outputs one level voltage from a plurality of level voltages based on an N-bit digital signal, includes:

a first sub-decoder 110 that receives as input a first level voltage set 170A, selects a plurality ("a" in number) of level voltages in accordance with a data signal (and complementary signal) of lower L-bits among the N-bit data signal (N is a prescribed positive integer greater than or equal to 2), and outputs these level voltages from output ends ("a" in number);

a second sub-decoder 120 that receives as input a second level voltage set 170B, selects a plurality ("b" in number) of level voltages in accordance with a data signal (and complementary signal) of lower L-bits, and outputs these level voltages from output ends ("b" in number);

a third sub-decoder 130 that selects one from a plurality ("a+b" in number) of level voltages selected by the first and second sub-decoders 110 and 120, in accordance with a data signal (and complementary signal) of higher M-bits among the N-bit data signal;

a fourth sub-decoder 140 that receives as input a third level voltage set 170C, and selects a plurality ("c" in number) of level voltages in accordance with a data signal (and complementary signal) of lower P-bits among the N-bit data signal, and outputs these level voltages from output ends ("c" in number);

a fifth sub-decoder 150 that selects one level voltage from output ends, "c" in number, of the fourth sub-decoder 140, in accordance with a data signal (and/or a complementary signal) of higher Q-bits among the N-bit data signal; and a sixth sub-decoder 160 that controls connection between at least one output end among the "a" output ends of the first sub-decoder 110 and at least one output end among the "c" output ends of the fourth sub-decoder 140 to be conductive or nonconductive based on K-bits (and/or a complementary signal) of the N-bit digital signal, and when conductive, supplies a voltage output from the at least one output end among the "a" output ends of the first sub-decoder 110 to at least one output end among the "c" output ends of the fourth sub-decoder 140.

The output of the third sub-decoder 130 and the output of the fifth sub-decoder 150 are connected to an output terminal OUT. From output 111 (the "a" output ends) of the first sub-decoder 110, "a"number of voltages are output. From output 121 (the "b" output ends) of the second sub-decoder 120, "b" number of voltages are output. From output 131 (the "c" output ends) of the fourth sub-decoder 140, "c" number of voltages are output.

Respective switches forming the first, second, and third sub-decoders 110, 120, and 130, are composed by transistors of a first polarity, and respective switches forming the fourth, fifth, and sixth sub-decoders 140, 150, and 160, are composed by transistors of a second polarity.

Figure 9:
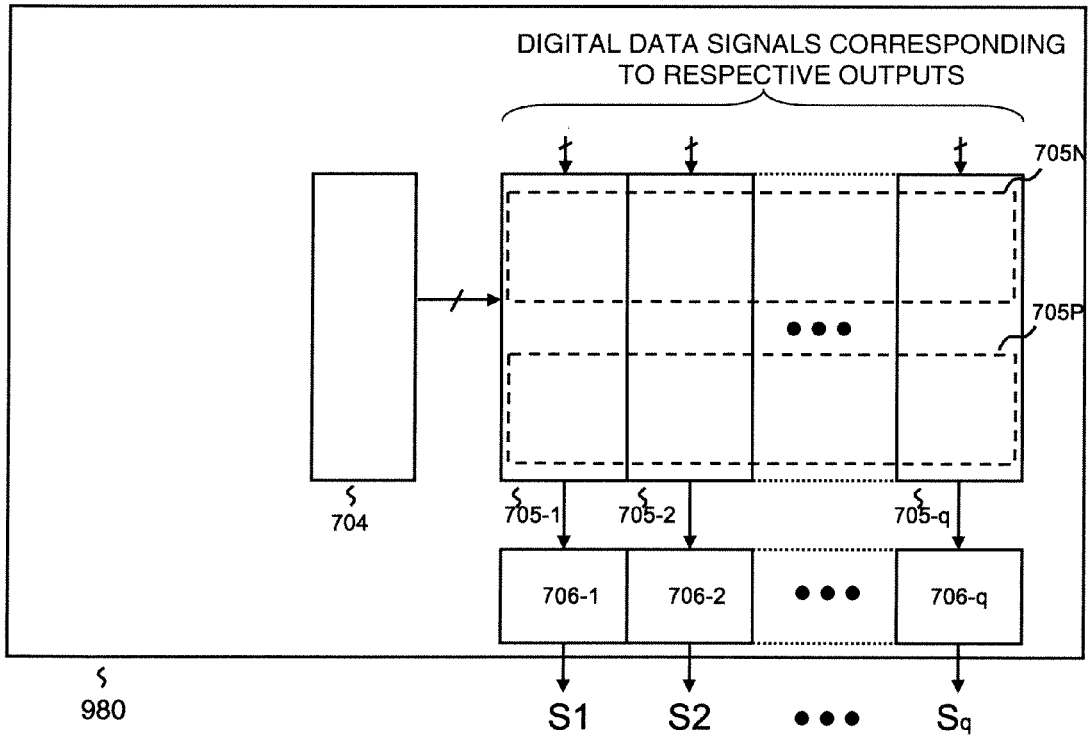
FIG. 9 is a diagram schematically showing a layout of a data driver (LSI chip).
Figure 10:
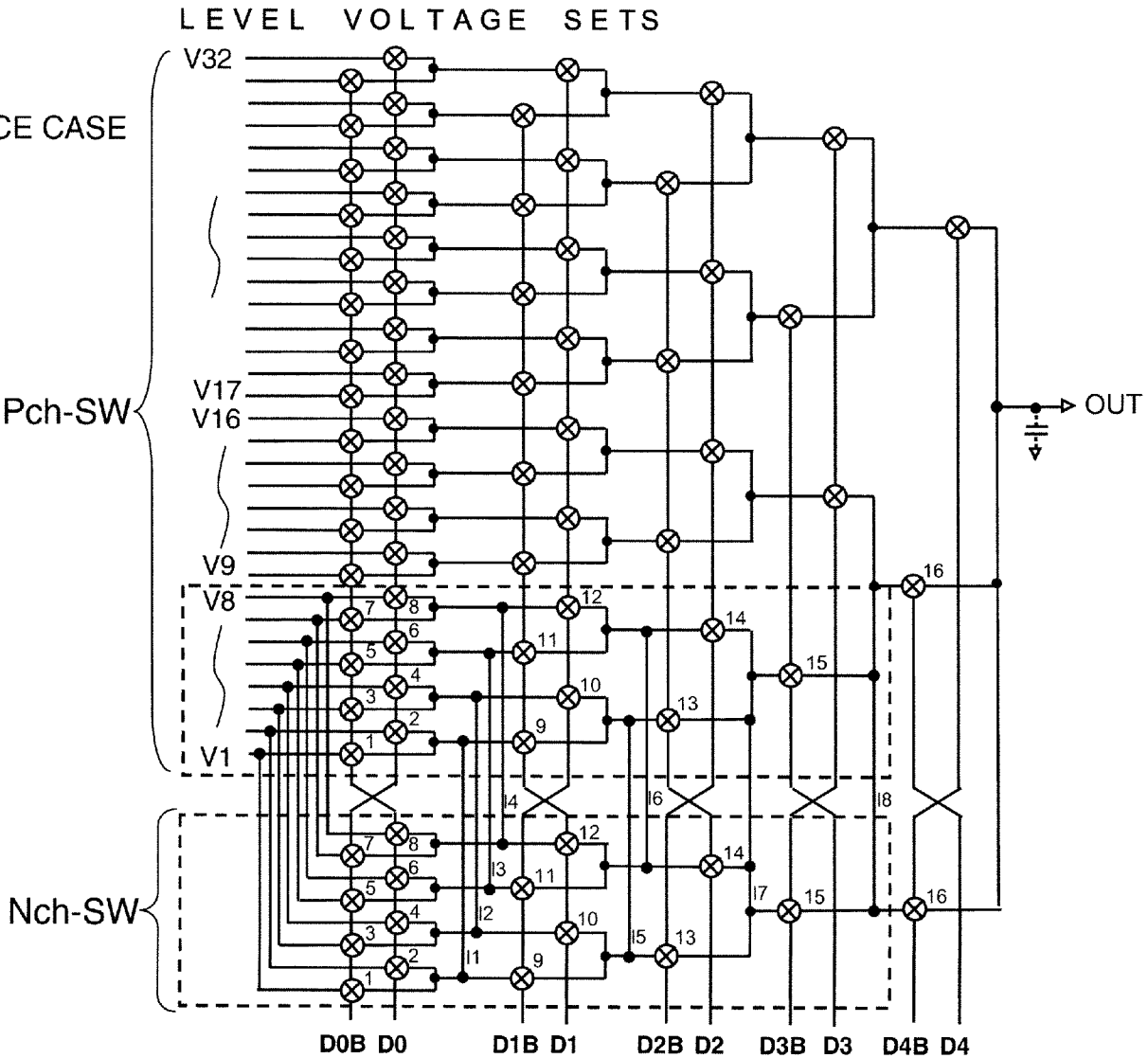
FIG. 10 is a diagram showing an example of a configuration of a decoder (level voltage selection circuit) of reference technology (comparative example).

A capacitance element C, between the output terminal OUT and ground, represents an output load capacitance. For example, in a case where the decoder circuit of FIG. 1 is applied to decoders 705-1 to **705-*q* of a data driver of FIG. 9, the output load capacitor C of FIG. 1 corresponds to wiring capacitance from each output terminal (output terminal OUT in FIG. 1) of the decoders 705-1 to 705-*q* of FIG. 9 to each input of the amplifier circuits 706-1 to 706-*q*, and input capacitance of each of the amplifier circuits 706-1 to 706-*q*. For this reason the decoder circuit of FIG. 1** requires drive capability for charging and discharging the load capacitor C within a prescribed time.

In FIG. 1, parameters K, L, M, N, P, and Q are set to satisfy the following relationships:

$P>L$;

$N>L\geq 1$;

$M>Q\geq 1$;

$P+Q=L+M=N$; and $K\geq 1$

A configuration may be adopted in which K-bits in the N-bit data signal, as shown in the following exemplary embodiments, may overlap, in bit position, with part of the higher bits (for example, the higher 1 bit or 2 bits) of the P-bits, or may overlap, in bit position, with the lower bits (for example, the lower 1 bit or 2 bits) of the M-bits.

The third level voltage set 170C includes one or more level voltages overlapping with the second level voltage set 170B (has one or more level voltages in common). That is, the third level voltage set 170C may include part or all of the second level voltage set 170B.

In the sixth sub-decoder 160, when a connection between at least one output end among the "a" output ends of the first sub-decoder 110 and at least one output end among the "c" output ends of the fourth sub-decoder 140 is in a conductive state, the fifth sub-decoder 150 receives as input at least one level voltage selected by the sixth sub-decoder 160 and output from at least one output end among the "c" output ends of the fourth sub-decoder 140.

An equivalent CMOS switch (not shown in FIG. 1) is composed by:

a first switch (not shown in FIG. 1) that is composed by a transistor of the second polarity, is arranged in the sixth sub-decoder 160, has a first terminal connected to at least one output end among the "a" output ends of the first sub-decoder 110, and is controlled to turned on and off by a corresponding bit line among K-bits; and a second switch (not shown in FIG. 1) that is composed by a transistor of the first polarity arranged in the third sub-decoder 130, has a first terminal connected in common with of the first switch in the sixth sub-decoder 160 to at least one output end among the "a"output ends of the first sub-decoder 110 and is controlled to be turned on/off by a bit signal and a complementary bit signal that control on and off of the first switch, among M-bits.

When the first switch in the sixth sub-decoder 160 and the second switch in the third sub-decoder 130 are both in an on state, second terminals of the first and second switches, are connected respectively, via the fifth sub-decoder 150 and via later stage circuits succeeding to the second switch in the third sub-decoder 130, to the output terminal OUT.

When a connection between at least one output end among the "a" output ends of the first sub-decoder 110, and at least one output end among the "c" output ends of the fourth sub-decoder 140 is non-conductive in the sixth sub-decoder 160, the fifth sub-decoder 150 receives as input the "c" level voltages selected by the fourth sub-decoder 140, and selects and outputs a level voltage to the output terminal OUT.

In the exemplary embodiments, an equivalent CMOS switch (not shown in FIG. 1) may be composed by:

a first transistor switch of the second polarity (not shown in FIG. 1) that is arranged in the fourth sub-decoder 140, receives the third level voltage set 170C; and a transistor switch of the first polarity (not shown in FIG. 1) in the second or third sub-decoder 120 or 130, that arranged in correspondence with the first transistor switch of the second polarity in the fourth sub-decoder 140, and is controlled to be conductive and non-conductive in common with the first transistor switch of the second polarity, by a bit signal and complementary bit signal that control conduction and non-conduction of the first transistor switch of the second polarity.

Another equivalent CMOS switch (not shown in FIG. 1) may be composed by:

a first transistor switches of the second polarity (not shown in FIG. 1) in the fifth sub-decoder 150 that is controlled to be conductive and non-conductive by one of a normal signal or a complementary signal of a signal of at least one bit of the Q-bits; and a second transistor switch of the first polarity (not shown in FIG. 1) in the third sub-decoder 130 that corresponds to the first switch transistor, and that is controlled to be conductive and non-conductive by a bit signal corresponding to the other of the normal signal or the complementary signal of the signal of at least one bit of the Q-bits among the M-bits. The following described the exemplary embodiments in detail.

First Exemplary Embodiment

Figure 2:
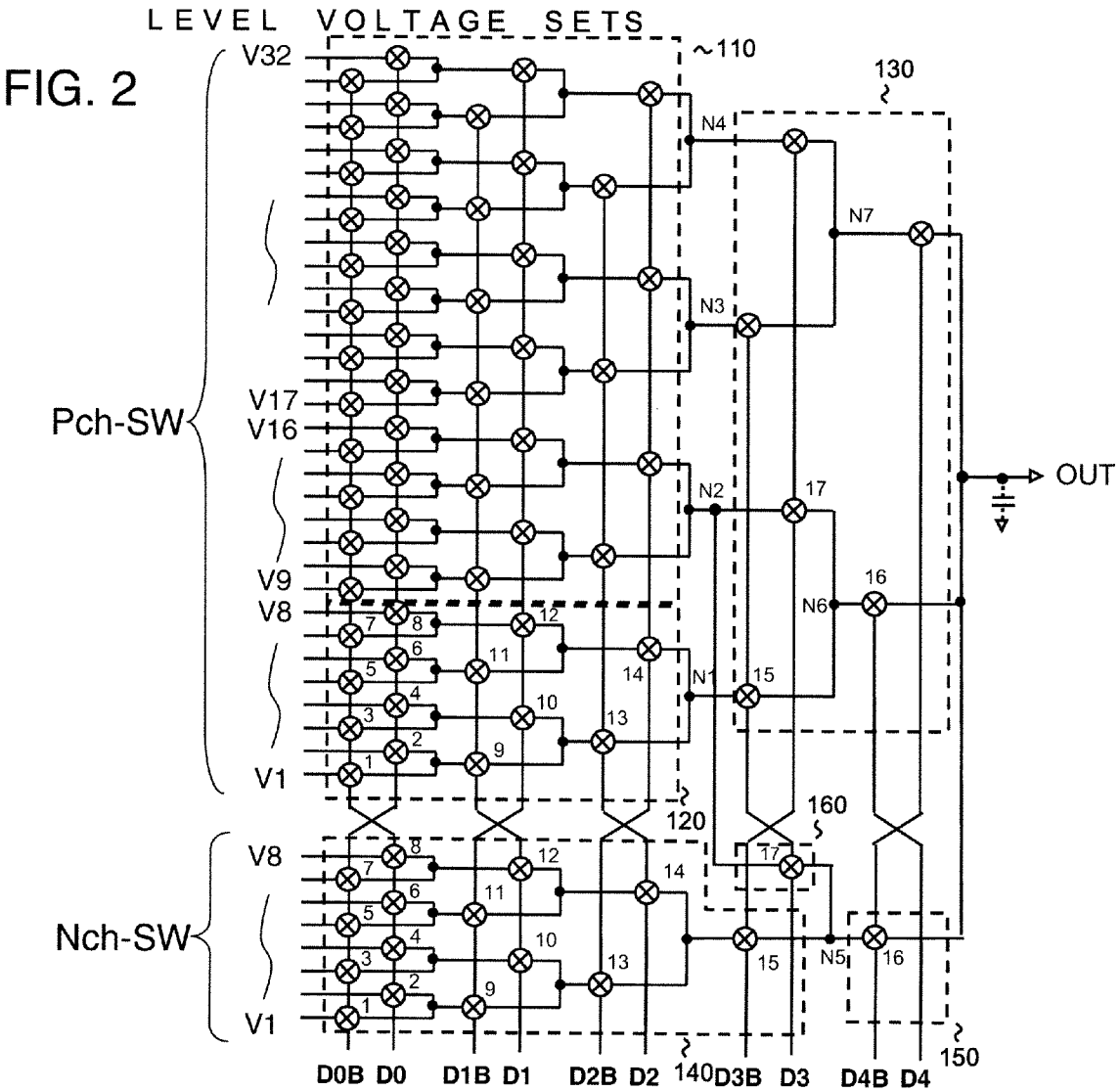
FIG. 2 is a diagram showing a configuration of a first exemplary embodiment.

FIG. 2 is a diagram showing an example of a specific configuration shown in FIG. 1. In this example, N, K, L, M, P, Q and first to third level voltage sets in FIG. 1 are as follow:

N=5,

K=1: D3,

L=3: D0 to D2, D0B to D2B,

M=2: D3 to D4, D3B to D4B,

P=4: D0 to D2, D0B to D3B,

Q=1: D4B, first level voltage set: V9 to V32, second level voltage set: V1 to V8, third level voltage set: V1 to V8 (overlapping with all of V1 to V8 of the second level voltage set).

Figure 8:
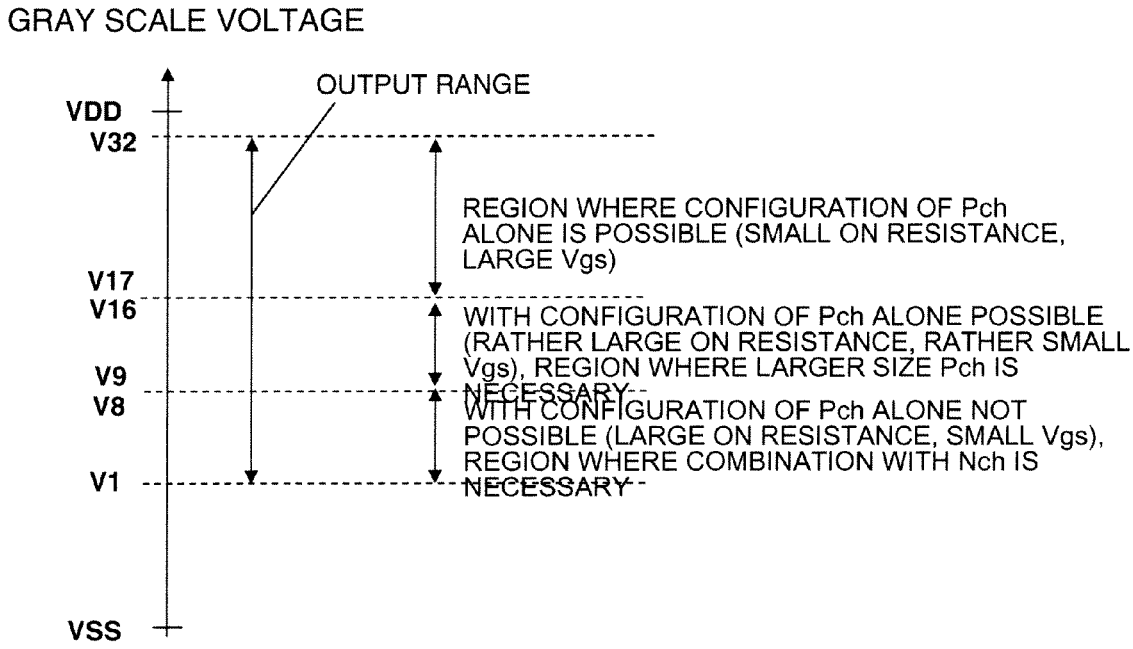
FIG. 8 is a diagram showing relationships of a gray scale voltage and output range of a Pch-SW and Nch-SW.

V1 to V32 in FIG. 2 correspond to V1 to V32 in FIG. 8 (VSS<V1<V2< . . . <V32<VDD).

V17 to V32 relate to a region where configuration is possible by Pch-SWs alone (the ON resistance of the Pch-SWs is small, and an absolute value of the gate-to-source voltage Vgs is large).

V9 to V16 relate to a region where configuration is possible by the Pch-SWs alone (the ON resistance of Pch-SW may be just large, and the absolute value of the gate-to-source voltage Vgs may be just small), and an increase in the gate width (W) of the Pch-SWs is necessary.

V1 to V8 relate to a region where configuration is not possible by the Pch-SWs alone, and combining with Nch-SWs (forming a CMOS) is necessary.

In FIG. 2, the first, second, and third sub-decoders 110, 120, and 130, are configured by Pch-SW composed by Pch-MOS transistors (pass transistors), and the fourth, fifth, and sixth sub-decoders 140, 150, and 160 are configured by Nch-SWs composed by Nch MOS transistors (pass transistors).

The sub-decoder 110 includes 42 Pch-SWs, a total of 24 level voltages of the first level voltage set: V9 to V32 are received, and three level voltages ("a"=3 in FIG. 1) are selected and output, in a three-stage tournament style, in accordance with the lower 3 bits of a 5 bit data signal and complementary signal thereof: (D0, D0B), (D1, D1B) and (D2, D2B).

More specifically, 12 among 24 Pch-SWs of a first stage are turned on by (D0, D0B), and 12 are selected from among the 24 level voltages, 6 among 12 Pch-SWs of a second stage are turned on by (D1, D1B) and 6 are selected from among the 12 level voltages, 3 among 6 Pch-SWs of a third stage are turned on by (D2, D2B) and 3 from among the 6 level voltages, thus 24÷8=3 level voltages, are selected and output. The 3 level voltages selected are respectively output from nodes N2, N3, and N4, forming 3 output ends ("a"=3 in FIG. 1).

In this example, one among the 8 level voltages V9 to V16 is selected and output from node N2, one among the 8 level voltages V17 to V24 is selected and output from node N3, and one among the 8 level voltages V25 to V32 is selected and output from node N4.

The second sub-decoder 120 includes 14 Pch-SWs, wherein 8reference voltages of the second level voltage set V1 to V8 are received, and one voltage is output to node N1 ("b"=1 in FIG. 1) that forms an output end, in tournament style, according to the lower 3 bits of a 5 bit data signal and a complementary signal thereof: (D0, D0B), (D1, D1B) and (D2, D2B).

The third sub-decoder 130 includes 6 Pch-SWs that select one from among 4 selected voltages respectively selected and output from output nodes N2, N3, and N4 of the first sub-decoder 110 and output node N1 of the second sub-decoder 120, in tournament style, in accordance with the higher 2 bits of a 5 bit data signal and complementary signal thereof: (D3, D3B) and (D4, D4B).

In the third sub-decoder 130, when D3=High and D4=High, a path including nodes N4 and N7 is selected and is conductive to the output terminal OUT, when D3=High and D4=Low, a path including nodes N2 and N6 is selected and is conductive to the output terminal OUT, when D3=Low and D4=High, a path including nodes N3 and N7 is selected and is conductive to the output terminal OUT, and when D3=Low and D4=Low, a path including nodes N1 and N6 is selected and is conductive to the output terminal OUT.

The fourth sub-decoder 140 includes 15 Nch-SWs 1 to 15, wherein 8 reference voltages of the third level voltage set are received, and one voltage is output, in tournament style, in accordance with the lower 3 bits of a data signal and a complementary signal thereof: (D0, D0B), (D1, D1B) and (D2, D2B), and a complementary bit signal D3B, to node N5 ("c"=1 in FIG. 1).

The fifth sub-decoder 150 includes the Nch-SW 16 that has a gate connected to a complementary signal D4B of the most significant bit signal D4 of the 5 bit data signal, and is connected between an output end (node N5) of the fourth sub-decoder 140 and the output terminal OUT.

The Nch-SW 16 of the fifth sub-decoder 150 forms an equivalent CMOS switch with the Pch-SW 16 in the third sub-decoder 130 that has a gate connected to the most significant bit signal D4, is connected between node N6 and the output terminal OUT, and is controlled to be turned on and off in common with the Nch-SW 16 at the same time.

The sixth sub-decoder 160 includes the Nch-SW 17 that has a gate connected to the bit signal D3, and is connected between a first output end (node N2) of the first sub-decoder 110 and the output end (node 5) of the second sub-decoder 120.

An equivalent CMOS switch is composed by the Nch-SW 17 in the sixth sub-decoder 160, and the Pch-SW 17 in the third sub-decoder 130, that has a gate connected to a complementary signal D3B of the bit signal D3, has one diffusion layer (source) connected to the first output end (node N2) of the first sub-decoder 110, and has the other diffusion layer (drain) connected to node N6. Namely, the Nch-SW 17 and the Pch-SW 17 function as an equivalent CMOS switch, in which first terminals (drain/source) of the Nch-SW 17 and the Pch-SW are connected in common to node N2, second terminals (source/drain) of the Nch-SW 16 and the Pch-SW 16 are connected to the output terminal OUT, through the Nch-SW 16 and the Pch-SW 16, and the Nch-SW 17 and the Pch-SW 17 are controlled to be on and off at the same time, in accordance with the bit signals (D3, D3B) and (D4, D4B).

Figure 11:
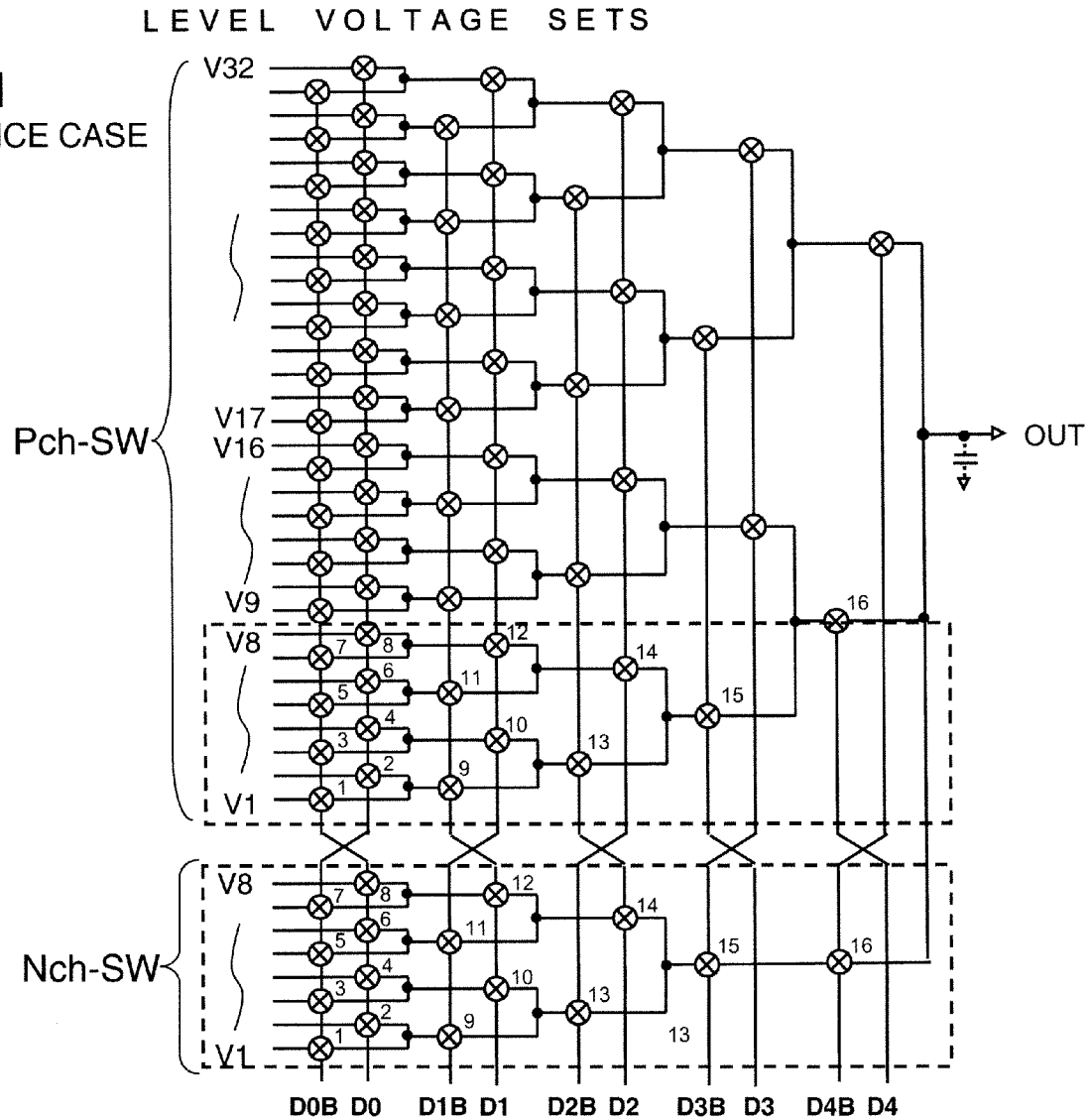
FIG. 11 is a diagram showing an example of a configuration of a decoder (level voltage selection circuit) of other reference technology (comparative example).
Figure 12A:
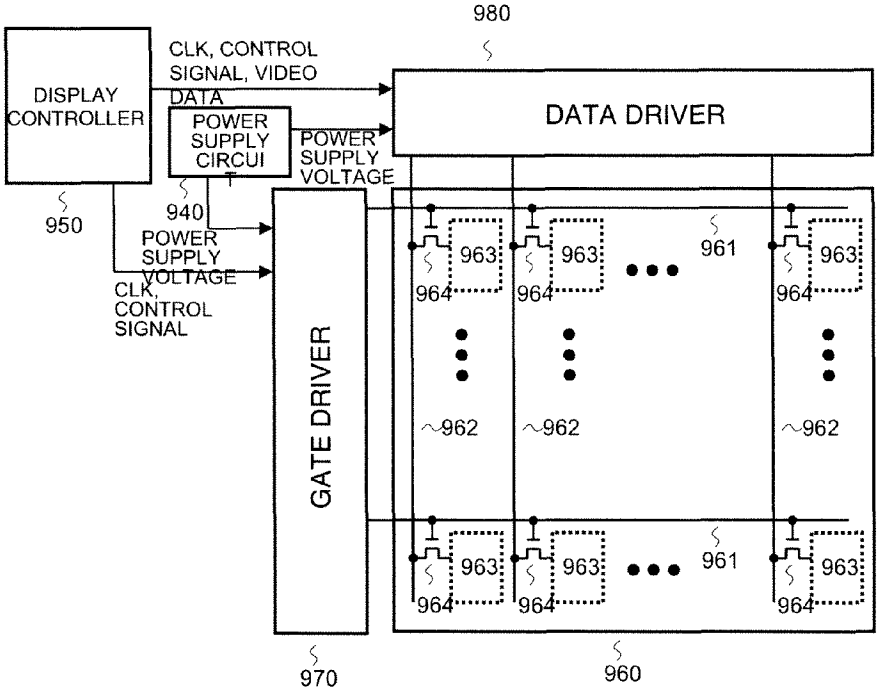
FIGS. 12A to 12C are diagrams showing an example of a configuration of a typical display device and display element (liquid crystal device, organic EL device).
Figure 12B:
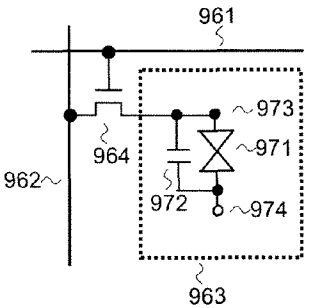
Figure 12C:
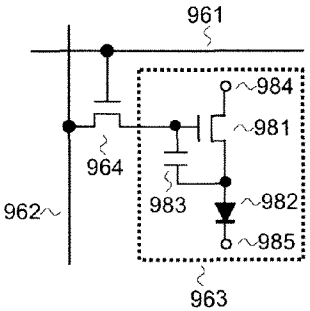

Each of 14 Pch-SWs 1 to 14 in the second sub-decoder 120 composes a CMOS switch with the corresponding one (having the same number) of 14 Nch-SWs 1 to 14 in the fourth sub-decoder 140, as in FIG. 11. In FIG. 2, the Pch-SW and the Nch-SW with the same reference number function as an equivalent CMOS switch.

In the present exemplary embodiment, the second level voltage set V1 to V8 and the third level voltage set V1 to V8 are identical. In case the decoder circuit of FIG. 2 is applied to the decoders 705-1 to 705-*q* of the data driver of FIG. 9, the level voltage set V1 to V8, as a preferable configuration, branches into the second and third level voltage sets immediately after output from the level voltage generation circuit 704. The second level voltage set V1 to V8 together with the first level voltage set V9 to V32 are wired in a longitudinal direction of the data driver in a Pch device region 705P of the decoders 705-1 to 705-*q*, and the third level voltage set V1 to V8 is wired in a longitudinal direction of the data driver in an Nch device region 705N of the decoders 705-1 to 705-*q*.

According to the present exemplary embodiment, one switch Nch-SW 17 and wiring between Pch/Nch regions connecting between the nodes N2 and N5, are added, as compared with the reference example shown in FIG. 11. Namely, with the addition of only a small number of transistor switches in the sixth sub-decoder 160, and a little wiring between the Pch/Nch regions, switches that select the level voltage set V9 to V16, and that is controlled to be turned on/off by 2higher bits (D3, D3B) and (D4, D4B) of a data signal, provide an equivalent CMOS switch configuration, and ON resistance can be reduced.

That is, among the switches connected in series on a path that selects the level voltage set V9 to V16 located adjacent to the level voltage set V1 to V8, which are selected by switches completely in CMOS configuration, among the Pch-SWs that select the first level voltage set V1 to V32, the Pch-SWs 15, 17, and 16, which are controlled to be turned on/off by the 2 higher bits (D3, D3B) and (D4, D4B) of a data signal, are combined with corresponding Nch-SWs 15, 17, and 16, to form equivalent CMOS switches. As a result, without increase of the gate width (W) of the Pch-SWs in the first sub-decoder 110, which are controlled to be turned on/off by the 3 lower bits (D0, D0B) to (D2, D2B) of a data signal, it is possible to suppress an increase in the ON resistance of switches on paths for selecting V9 to V16, and to suppress an increase in area.

In the present exemplary embodiment, the above-mentioned tournament system is preferably adopted in the configuration of the sub-decoders. In a non-tournament style configuration, the number of switch transistors to be added in order to have a CMOS configuration may increase.

According to the present exemplary embodiment, among the switches selecting V9 to V16, by making a CMOS configuration of switches that is selected (made conductive) in accordance with the higher bits of the data signal, it is possible to reduce the ON resistance and to suppress an increase in gate width of the transistor switches that are controlled to be turned on (conductive)/off (non-conductive) according to the lower bits of the data signal.

In the example shown in FIG. 2, the bit number N of the data signal was 5 bits, but in a case of N=6 bits or more, for example, the number of level voltages corresponding to V9 to V16 in FIG. 2 is 2 or more times the case of N=5 (8 level voltages). Therefore, in a case of N=6 bits or more, since the number of transistor switches selecting the level voltages corresponding to V9 to V16 is over 2 times as many. Thus, if the gate width of these transistor switches is increased, or, entirety of the switches have CMOS configuration, the area of the decoders significantly increases. According to the present exemplary embodiment, by only adding a small number of transistor switches in the sixth sub-decoder 160, it is possible to make CMOS configuration of Pch-SWs of at least 2 bits from the highest position, an increase in gate width of the Pch-SWs of the lower bit side can be suppressed and it is possible to suppress an increase in decoder area. The more bits the data signal has, the larger is the suppressing effect on an increase in area of the decoder in the present exemplary embodiment, and the decoder area is decreased as compared with a decoder to which the present exemplary embodiment is not applicable.

The present exemplary embodiment shown in FIG. 2 can be applied to a configuration of a decoder corresponding to an output range of the OLED described making reference to FIG. 8, or a positive decoder applied to a positive polarity output range of an LCD.

Second Exemplary Embodiment

Figure 3:
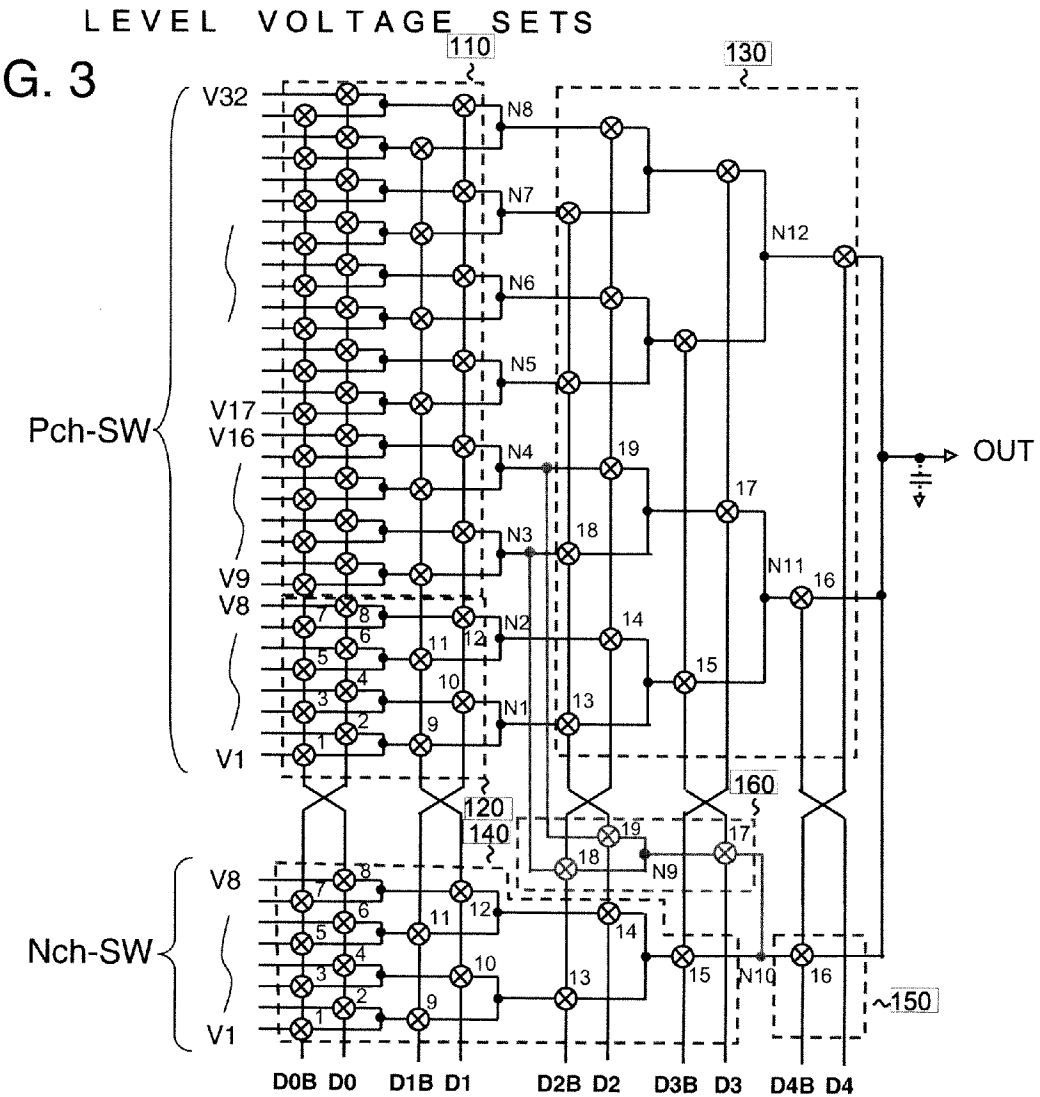
FIG. 3 is a diagram showing a configuration of a second exemplary embodiment.

FIG. 3 is a diagram showing a configuration of a second exemplary embodiment of the present invention. The present exemplary embodiment is an example, with respect to FIG. 1, in which:

N=5

L=2: D0 to D1, D0B to D1B

M=3: D2 to D4, D2B to D4B

P=4: D0 to D3, D0B to D3B

Q=1: D4B

K=2: D2 to D3, D2B first level voltage set: V9 to V32 second level voltage set: V1 to V8, and third level voltage set: V1 to V8 (overlapping with all of V1 to V8 of a second level voltage set).

Referring to FIG. 3, a first sub-decoder 110 includes 36 Pch-SWs, selects 6 voltages, in accordance with (D0, D0B) to (D1, D1B), from among the first level voltage set V9 to V32 (24 level voltages), and outputs selected 6 voltages from 6 output ends (nodes N3 to N8; "a"=6 in FIG. 1). A second sub-decoder 120 includes 12 Pch-SWs, receives 8 level voltages of the second level voltage set V1 to V8, selects 2 voltages in accordance with (D0, D0B) to (D1, D1B), and outputs the selected 2 voltages to 2 output ends (nodes N1 and N2; "b"=2 in FIG. 1).

A third sub-decoder 130 includes 14 Pch-SWs, receives voltages from the 8 output ends (N1 to N8; a+b=8 in FIG. 1) of the first and second sub-decoders 110 and 120, and selects and outputs one voltage in accordance with the 3 higher bits (D2, D2B) to (D4, D4B) of a data signal to an output terminal (OUT).

A fourth sub-decoder 140 includes 15 Nch-SWs, receives 8 level voltages of the third level voltage set V1 to V8, and selects and outputs one voltage in accordance with (D0, D0B) to (D2, D2B), and D3B, to an output end (node N10; "c"=1 in FIG. 1).

A fifth sub-decoder 150 includes Nch-SW 16 that has a gate connected to D4B, and that is connected between the output end (node N10) of the fourth sub-decoder and the output terminal OUT.

A sixth sub-decoder 160 includes:

Nch-SW 17 that has one diffusion layer (drain) connected to a node N9, has the other diffusion layer (source) connected to an output end (node N10) of the fourth sub-decoder 140, and has a gate connected to D3 respectively; and Nch-SWs 18 and 19 that have diffusion layers (drain) connected respectively to the first and second output ends (nodes N3 and N4) of the first sub-decoder 110, and a gate connected to D2B and D2, wherein other diffusion layers (sources) of the Nch-SWs 18 and 19 are connected in common to the node N9.

In the present exemplary embodiment, as shown in FIG. 3, the Nch-SWs 18 and 19 are added to the configuration of FIG. 2. Among Pch-SWs that select V9 to V16, switches that are selected in accordance with (D2, D2B) to (D4, D4B) are made to have a CMOS configuration, and hence a low ON resistance is realized. In this way, there is no need to increase the gate width of switches in the first sub-decoder 110 that are selected in accordance with (D0, D0B) and (D1, D1B), among the Pch-SWs that select V9 to V16, and it is possible to suppress an increase in area. That is, by adding just a few Pch-SWs (Pch-SW17, 18 and 19) in the sixth sub-decoder 160 and a little inter-Pch/Nch wiring (wiring between nodes N3 and N10 and between nodes N4 and N10), it is possible to reduce ON resistance of switches that select V9 to V16, and to reduce decoder area. In the present exemplary embodiment, similar to the first exemplary embodiment, a tournament configuration is preferably applied. The present embodiment may be applied to a decoder corresponding to an output range of an OLED or to a positive decoder corresponding to a positive polarity output range of an LCD.

Third Exemplary Embodiment

Figure 4:
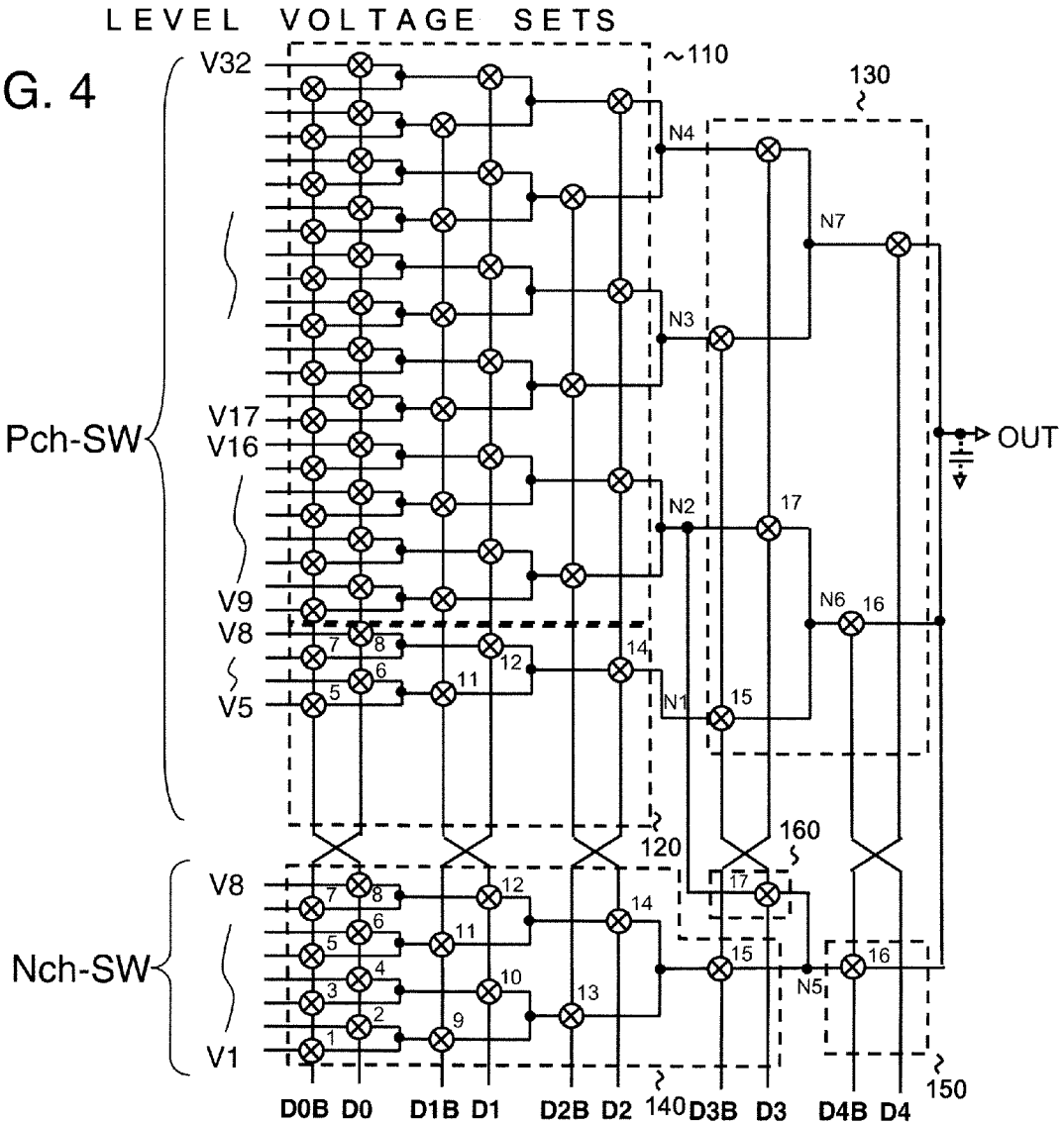
FIG. 4 is a diagram showing a configuration of a third exemplary embodiment.

FIG. 4 is a diagram showing a configuration of a third exemplary embodiment of the present invention. The present exemplary embodiment is shown in a diagram of a configuration example wherein level voltages V1 to V4 cannot be selected by Pch-SWs. A level voltage set V1 to V4 is selected by Nch-SWs alone. The present exemplary embodiment is an example, with respect to FIG. 1, in which:

N=5

L=3: D0 to D2, D0B to D2B

M=2: D3 to D4, D3B to D4B

P=4: D0 to D3, D0B to D3B

Q=1: D4B

K=2: D3 first level voltage set: V9 to V32, second level voltage set: V5 to V8, and third level voltage set: V1 to V8 (V5 to V8 overlaps with V5 to V8 of the second level voltage set).

Referring to FIG. 4, a first sub-decoder 110 includes 42 Pch-SWs, and selects and outputs 3 voltages, in accordance with (D0, D0B) to (D2, D2B), from among the first level voltage set V9 to V32 (24 level voltages), to 3 output ends (nodes N2, N3, and N4; "a"=3 in FIG. 1).

A second sub-decoder 120 includes 7 Pch-SWs, receives 4 level voltages of the second level voltage set V5 to V8, and selects and outputs one voltage in accordance with (D0, D0B) to (D2, D2B), to an output end (node N1; "b"=1 in FIG. 1).

A third sub-decoder 130 includes 6 Pch-SWs, receives voltages from the 4 output ends (nodes N1 to N4) of the first and second sub-decoders 110 and 120, and selects and outputs one voltage by the 2 higher bits (D3, D3B) and (D4, D4B) of a data signal, to an output terminal (OUT).

A fourth sub-decoder 140 includes 15 Nch-SWs, receives 8 level voltages of the third level voltage set V1 to V8, and selects and outputs one voltage in accordance with (D0, D0B) to (D2, D2B), and D3B, to an output end (node N5; "c"=1 in FIG. 1).

A fifth sub-decoder 150 includes Nch-SW 16 that has a gate connected to D4B, and is connected between an output end (node N5) of the fourth sub-decoder 140 and the output terminal OUT.

A sixth sub-decoder 160 includes Nch-SW 17 that has one diffusion layer (drain) connected to a node N2, has the other diffusion layer (source) connected to an output end (node N5) of the fourth sub-decoder 140, and has a gate connected to D3.

An equivalent CMOS switch is composed by Nch-SW 17 in the sixth sub-decoder 160, and a Pch-SW 17 in the third sub-decoder 130 that has a gate connected to D3B which is a complementary signal of D3 and is connected between a first output end (node N2) of the first sub-decoder 110 and node N6.

Each of the Pch-SWs 5 to 14 in the second sub-decoder 120 forms a CMOS switch with a corresponding one (having the same number) of the Nch-SWs 5 to 14 in the fourth sub-decoder 140. Pch-SW and Nch-SW with the same reference number, as with FIG. 2, compose a CMOS switch.

Nch-SW 15 in the fourth sub-decoder 140 and Pch-SW 15 in the third sub-decoder 130 compose a CMOS switch.

Nch-SW 16 in the fifth sub-decoder 150 and Pch-SW 16 in the third sub-decoder 130 compose a CMOS switch.

In the present exemplary embodiment, with respect to switches that select V9 to V16, switches that are controlled to be turned on (conductive)/off (non-conductive) in accordance with (D3, D3B) and (D4, D4B) form an equivalent CMOS switch, and the ON resistance is decreased. For this reason, among switches on paths for selecting V9 to V16, it is possible to suppress an increase in the size of gate width (W) of Pch-SWs in the first sub-decoder 110 that are controlled to be turned on/off in accordance with (D0, D0B) to (D2, D2B). That is, by adding only a few Nch-SWs in the sixth sub-decoder 160 and a small number of inter-Pch/Nch wiring (wiring between node N2 and Nch-SW 17), it is possible to lower the ON resistance of a switch that selects V9 to V16, and to reduce the decoder area.

The exemplary embodiment shown in FIG. 4 can be applied to a decoder corresponding to an output range of an OLED, or to a positive decoder corresponding to a positive polarity output range of an LCD.

Fourth Exemplary Embodiment

Figure 5:
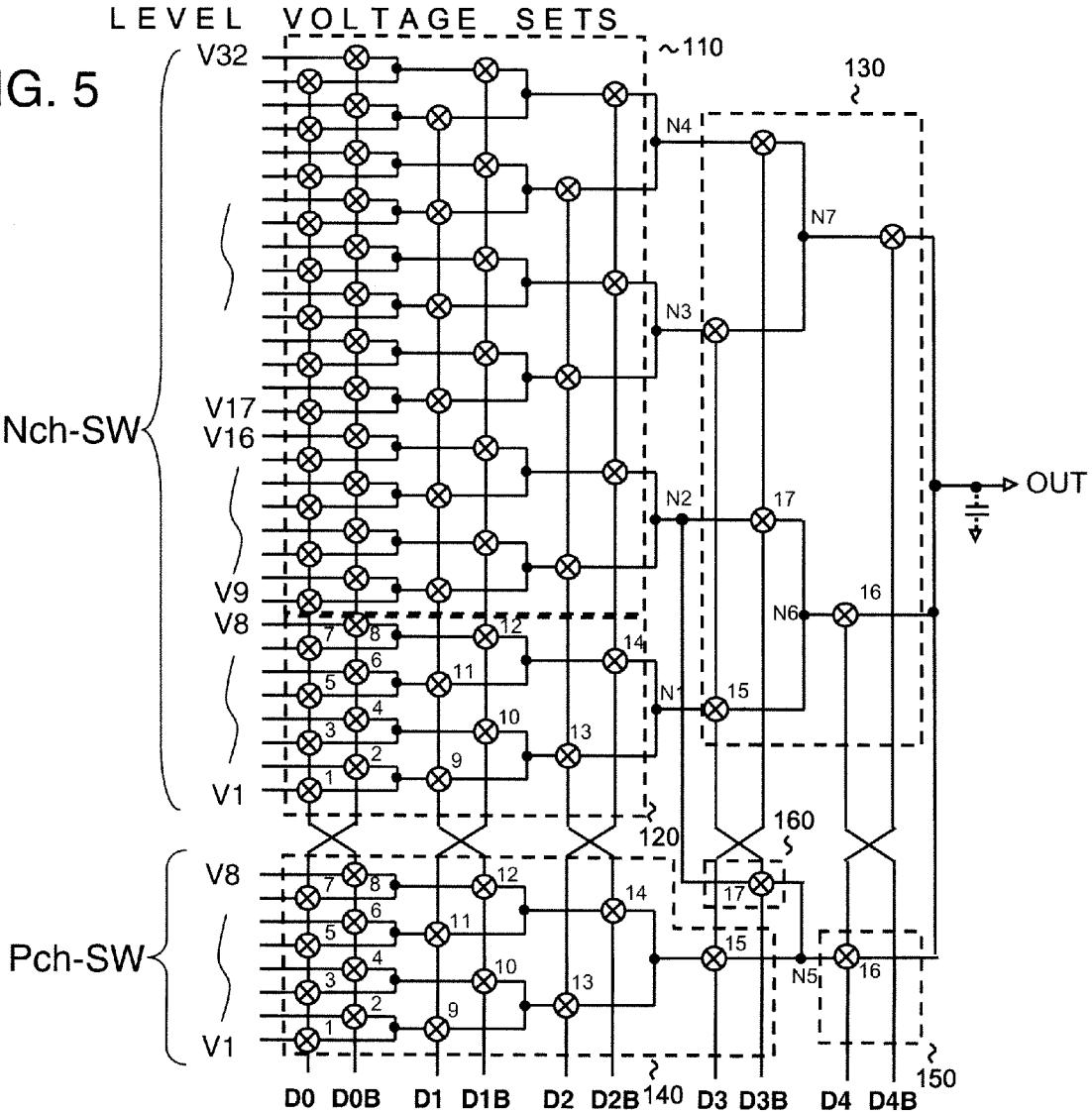
FIG. 5 is a diagram showing a configuration of a fourth exemplary embodiment.
Figure 6A:
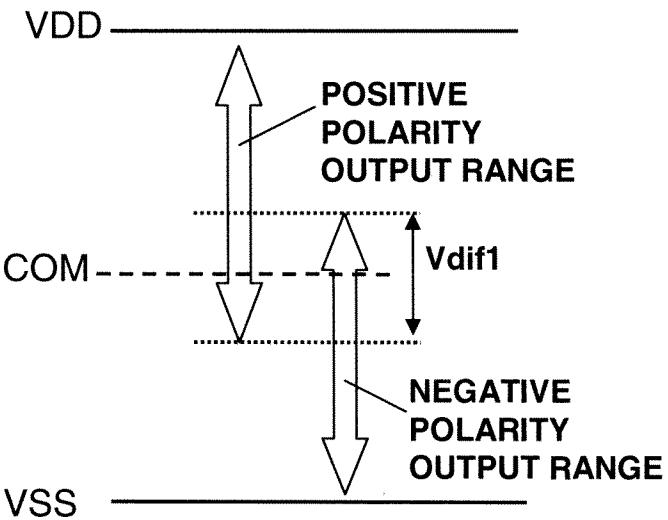
FIGS. 6A and 6B are diagrams schematically showing an example of an output range of an LCD driver and an example of an output range of an OLED display driver.
Figure 6B:
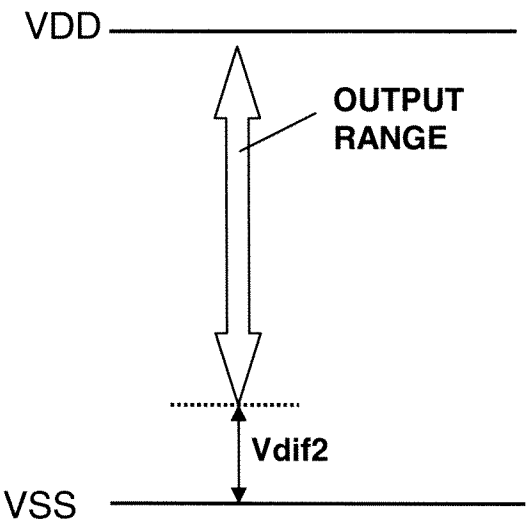
Figure 7A:
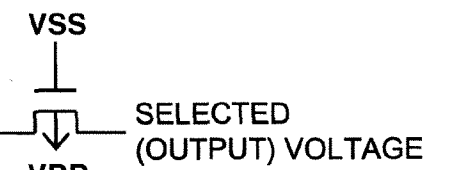
FIGS. 7A to 7D are diagrams for describing relationships between selected voltage of a Pch-SW and Nch-SW, and ON resistance.
Figure 7B:
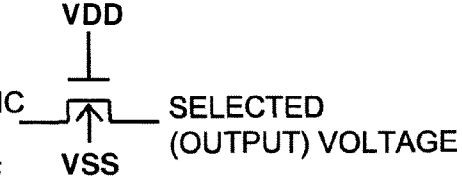
Figure 7C:
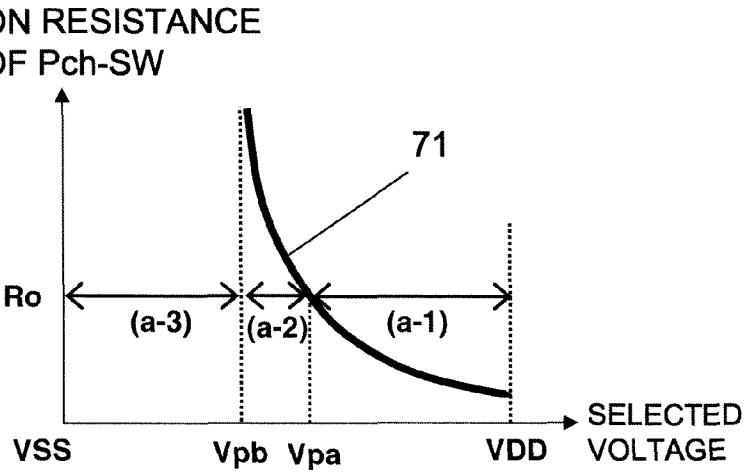
Figure 7D:
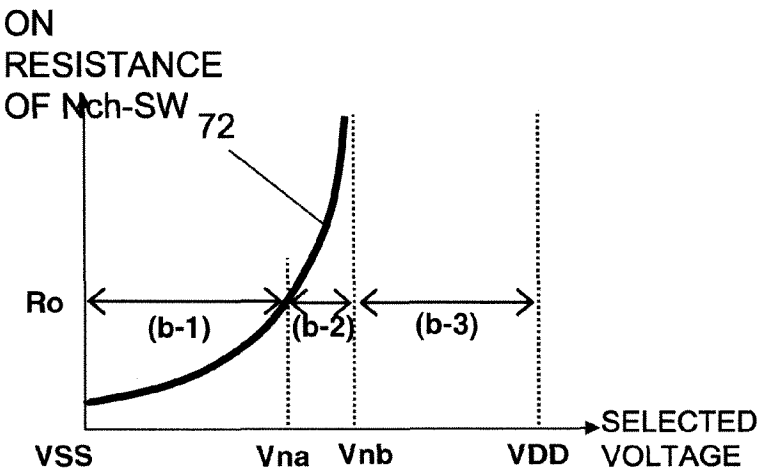

FIG. 5 is a diagram showing a configuration of a fourth exemplary embodiment of the present invention. In the present exemplary embodiment, the diagram shows a configuration of a level voltage selection circuit that can be applied to a configuration of a negative decoder corresponding to a negative polarity output range of an LCD. Referring to FIG. 5, Pch-SWs and Nch-SWs are interchanged with respect to a configuration of FIG. 2, and together with a change of switch polarity, positions of a normal signal and a complementary signal of a bit signal are interchanged. Furthermore, a relationship among a level voltage set V1 to V32 corresponding to the negative polarity output range is opposite to the relationship among a level voltage set V1 to V32 corresponding to a positive polarity output range, being VSS<V32< . . . <V1<VDD. V17 to V32 belong to a range in which configuration is possible by Nch-SWs alone (the ON resistance of the Nch-SWs is small, and gate-to-source voltage Vgs is large). For a range of V9 to V16, configuration is possible by the Nch-SWs alone (the ON resistance of the Nch-SWs may be just large, and the gate-to-source voltage Vgs may be just small), but this is a range where an increase in the gate width (W) of the Nch-SWs is necessary. For a range of V1 to V8, configuration is not possible by the Nch-SWs alone so that it is necessary to combine Nch-SW and Pch-SW to compose a CMOS switch.

In the example shown in FIG. 5, a first sub-decoder 110 includes from 42 Nch-SWs, receives a first level voltage set V9 to V32, and selects and outputs 3 voltages, based on (D0, D0B), (D1, D113), and (D2, D2B), to 3 output ends (nodes N2, N3, and N4; "a"=3 in FIG. 1).

A second sub-decoder 120 includes 14 Nch-SWs, receives a second level voltage set V1 to V8 (V1>V2> . . . >V8), and selects and outputs one voltage based on (D0, D0B), (D1, D1B and (D2, D2B), to one output end (node N1; "b"=1 in FIG. 1).

A third sub-decoder 130 receives voltage of 4 output ends (nodes N1 to N4) of the second and first sub-decoders 120 and 110, and selects and outputs one voltage based on (D3, D3B) and (D4, D4B), to an output terminal OUT.

A fourth sub-decoder 140 includes 15 Pch-SWs, receives a third level voltage set V1 to V8, and selects and outputs one voltage based on (D0, D0B), (D1, D1B), (D2, D2B) and D3, to one output end (node N5; "c"=1 in FIG. 1).

A fifth sub-decoder 150 includes one Nch-SW 16 that is connected between an output end (node N5) of the fourth sub-decoder 140 and the output terminal OUT, and is controlled to be turned on/off in accordance with the most significant bit D4 of a data signal.

A sixth sub-decoder 160 includes one Nch-SW 17 that has one diffusion layer (drain) connected to an output end (node N2) of the first sub-decoder 110, and the other diffusion layer (source) connected to the output end (node N5) of the fourth sub-decoder 140.

Each of the 14 Nch-SWs 1 to 14 in the second sub-decoder 120 compose a CMOS switch with a corresponding one of the 14 Pch-SWs 1 to 14 in the fourth sub-decoder 140. That is, Pch-SW and Nch-SW with the same reference number, as with FIG. 2, compose a CMOS switch.

The Nch-SW 15 (controlled to be turned on/off by D3B) in the third sub-decoder 130, and the Pch-SW 15 (controlled to be turned on/off by D3) in the fourth sub-decoder 140 compose a CMOS switch.

The Nch-SW 16 (controlled to be turned on/off by D4B) in the third sub-decoder 130, and the Pch-SW 16 (controlled to be turned on/off by D4) in the fifth sub-decoder 150 compose a CMOS switch.

The Nch-SW 17 (controlled to be turned on/off by D3) in the third sub-decoder 130, and the Pch-SW 17 (controlled to be turned on/off by D3B) in the sixth sub-decoder 150 compose a CMOS switch. That is, in FIG. 5, Pch-SWs and Nch-SWs with the same reference number configure a CMOS switch.

According to the present exemplary embodiment, by adding one or a small number of transistor switches (Pch-SW 17) in the sixth sub-decoder 160, with a little wiring between Pch/Nch regions (wiring between the nodes N2 and N5), switches controlled to be turned on/off by 2 higher bits (D3, D3B) and (D4, D4B) of a data signal among switches that select the level voltage set V9 to V16, are made to have a CMOS switch configuration, thereby reducing ON resistance of the switch. Without increase in the gate width (W) of Nch-SWs in the first sub-decoder 110 which are controlled to be turned on and off in accordance with the lower 3 bits (D0, D0B) to (D2, D2B) of the data signal among the switches that select the level voltage set V9 to V16, it is possible to suppress an increase of the ON resistance of switches provided on paths selecting V9 to V16, and it is possible to suppress an increase in area. The above described level voltage selection circuit able to be used as an digital to analog converter which receives a digital signal (N-bit digital signal), converts the digital signal to an associated analog signal (voltage) and outputs the converted analog signal.

Each disclosure of the abovementioned patent documents is incorporated herein by reference. Modifications and adjustments of embodiments and examples are possible within the bounds of the entire disclosure (including the scope of the claims) of the present invention, and also based on fundamental technological concepts thereof. Furthermore, a wide variety of combinations and selections of various disclosed elements are possible within the scope of the claims of the present invention. That is, the present invention clearly includes every type of transformation and modification that a person skilled in the art can realize according to the entire disclosure including the scope of the claims and to technological concepts thereof.

What is claimed is:

1. A level voltage selection circuit that receives a plurality of level voltages, selects one level voltage from among said plurality of level voltages received, responsive to an N-bit digital signal, where N is an integer greater than or equal to 2, and outputs said one level voltage selected from an output terminal thereof, said plurality of level voltages including:

a first level voltage set;

a second level voltage set; and a third level voltage set, respective voltage ranges of said first level voltage set and said second level voltage set not mutually overlapping, and said third level voltage set and said second level voltage set including one or a plurality of level voltages in common, said level voltage selection circuit comprising:

a first sub-decoder that receives said first level voltage set, said first sub-decoder including a plurality of switches controlled to be conductive or non-conductive based on a predetermined lower L-bit signal of said N-bit digital signal to select a first number of level voltages from said first level voltage set received, said first sub-decoder including a plurality of output ends, the number of which is the same as said first number and which output said first number of level voltages selected by said plurality of switches included in said first sub-decoder;

a second sub-decoder that receives said second level voltage set, said second sub-decoder including a plurality of switches controlled to be conductive or non-conductive based on said L-bit signal of said N-bit digital signal to select a second number of level voltages from said second level voltage set received, said second sub-decoder including a plurality of output ends, the number of which is the same as said second number and which output said second number of level voltages selected by said plurality of switches included in said second sub-decoder;

a third sub-decoder that receives a plurality of level voltages output from said first and said second sub-decoders, the number of said plurality of level voltages received being a sum of said first number and said second number, said third sub-decoder including a plurality of switches controlled to be conductive or non-conductive based on a predetermined higher M-bit signal of said N-bit digital signal, to select one level voltage from said plurality of level voltages received, the number thereof being a sum of said first number and said second number, output from said first and said second sub-decoders, said third sub-decoder outputting said one level voltage, selected by said plurality of switches included in said third sub-decoder, to said output terminal;

a fourth sub-decoder that receives said third level voltage set, said fourth sub-decoder including a plurality of switches controlled to be conductive or non-conductive based on a predetermined lower P-bit signal of said N-bit digital signal to select a third number of level voltages from said third level voltage set received, said fourth sub-decoder including a plurality of output ends, the number of which is the same as said third number and which output said third number of level voltages selected by said plurality of switches included in said fourth sub-decoder;

a fifth sub-decoder that receives said third number of level voltages output from said third number of output ends of said fourth sub-decoder, said fifth sub-decoder including a plurality of switches controlled to be conductive or non-conductive based on a predetermined higher Q-bit signal of said N-bit digital signal to select one level voltage from among said third number of level voltages output from said third number of output ends of said fourth sub-decoder, said fifth sub-decoder outputting said one level voltage, selected by said plurality of switches included in said fifth sub-decoder, to said output terminal, and a sixth sub-decoder that includes at least one switch arranged between one output end among said first number of output ends of said first sub-decoder and one output end among said third number of output ends of said fourth sub-decoder, and controlled to be conductive or non-conductive based on a predetermined K-bit signal of said N-bit digital signal, said one switch, when conductive, outputting a level voltage output from said one output end of said first sub-decoder, to said one output end of said fourth sub-decoder, wherein said switches of said first to third sub-decoders includes transistors of a first polarity, respectively, said switches of said fourth to sixth sub-decoders includes transistors of a second polarity, respectively, and said N, L, M, P, Q, and K, each being a positive integer, are set to satisfy the following relationships:

P is greater than L;

L is greater than or equal to 1, and less than N;

M is greater than Q, and Q is greater than or equal to 1;

a sum of P and Q is equal to N, and a sum of L and M is equal to N; and

K is greater than or equal to 1.

2. The level voltage selection circuit according to claim 1, wherein said at least one switch in said sixth sub-decoder comprises a first switch composed by a first transistor of said second polarity, said first switch being connected to said one output end among output ends, the number of which is the same as said first number of said first sub-decoder, and controlled to be conductive or non-conductive in accordance with a bit signal corresponding to one of a normal signal and a complementary signal of one bit signal of said K-bits, and said plurality of switches in said third sub-decoder comprises a second switch composed by a second transistor of said first polarity, said second switch being connected to said one output end among output ends, the number of which is the same as said first number of said first sub-decoder, and controlled to be conductive or non-conductive in accordance with a bit signal corresponding to the other of said normal signal and said complementary signal of said bit signal of said one bit signal of said K-bits among said M bits, said first and second switches being controlled to be conductive or non-conductive in common to configure an equivalent CMOS switch.

3. The level voltage selection circuit according to claim 1, wherein said plurality of said switches in said fourth sub-decoder comprises a first switch composed by a first transistor of said second polarity, and controlled to be conductive or non-conductive in accordance with a bit signal corresponding to one of a normal signal and a complementary signal of a bit signal of said predetermined lower P-bit signal, and said plurality of said switches in one of said second decoder and said third sub-decoder comprises a second switch composed by a second transistor of said first polarity, said second switch being arranged in correspondence with said first switch included in said fourth sub-decoder, and controlled to be conductive or non-conductive in accordance with a bit signal corresponding to the other of said normal signal and said complementary signal of said bit signal of said predetermined lower P-bit signal, said first and second switches being controlled to be conductive or non-conductive in common to configure a first equivalent CMOS switch, and wherein said plurality of switches in said fifth sub-decoder comprises a third switch composed by a third transistor of said second polarity, said third switch being controlled to be conductive or non-conductive in accordance with a bit signal corresponding to one of a normal signal and a complementary signal of one bit signal of said Q-bits, and said plurality of switches in said third sub-decoder comprises a fourth switch composed by a fourth transistor of said first polarity, said fourth switch being arranged in correspondence with said third switch included in said fifth sub-decoder, and controlled to be conductive or non-conductive in accordance with a bit signal corresponding to the other of said normal signal and said complementary signal of said one bit signal of said Q-bits among said M-bits, said third and fourth switches being controlled to be conductive or non-conductive in common to configure a second equivalent CMOS switch.

4. The level voltage selection circuit according to claim 1, wherein said third level voltage set supplied to said fourth sub-decoder includes all or a part of said second level voltage set in common, a level voltage which said third level voltage set includes in common with said second level voltage set being connected by wiring to respective inputs of said second sub-decoder and said fourth sub-decoder.

5. The level voltage selection circuit according to claim 1, wherein a level voltage set obtained by combining said first to third level voltage sets includes a plurality of level voltages of mutually different voltages, the number of which is N-th power of 2, wherein said first, second, and third sub-decoders constitute a tournament configuration, in which a plurality of level voltages, the number of which is 2 to (N−1)-th power, are selected in accordance with a first bit, which is the least significant bit of said N-bit digital signal, from said level voltage set, the number of which is 2 to the N-th power, a plurality of level voltages, the number of which is 2 to the (N−2)-th power, are selected from said level voltages, the number of which is 2 to the (N−1)-th power, in accordance with a second bit one bit higher than said first bit, and finally one level voltage is selected in accordance with the most significant N-th bit signal of said N-bit data signal, from two level voltages selected by a (N−1)-th bit one bit lower than said N-th bit of said N-bit data signal, wherein said third level voltage set includes a plurality of level voltages, the number of which is 2 to the (P−1)-th power, wherein said plurality of switches in said fourth sub-decoder comprises a plurality of first switches controlled to be conductive or non-conductive, in accordance with a bit signal corresponding to a normal signal or a complementary signal of each bit from said first bit to (P−1)-th bit among P-bits, each of said first switches composed by a transistor of said second polarity; and a second switch composed by a transistor of said second polarity, said second switch being controlled to be conductive or non-conductive by one of said P-th bit and a complementary signal of said P-th bit, said plurality of said first switches in said fourth sub-decoder constituting a tournament configuration in which a plurality of level voltages, the number of which is 2 to the (P-2)-th power, are selected by said first bit, from among a plurality of level voltages, the number of which is 2 to the (P−1)-th power, and one level voltage is selected in accordance with said (P−1)-th bit from two voltages selected in accordance with a (P-2)-th bit one bit lower than said (P−1)-th bit, said second switch receiving said one level voltage, selected in accordance with said (P−1)-th bit, wherein said plurality of switches in said second sub-decoder comprises a plurality of third switches, each of said third switches composed by a transistor of said first polarity, each of said third switches arranged in correspondence with each of said first switches in said fourth sub-decoder and controlled to be conductive or non-conductive in accordance with a bit signal corresponding to a normal signal or a complementary signal of each bit from said first bit to said (P−1)-th bit among said L bits, a plurality of pairs of said first switches in said fourth sub-decoder and said third switches in said second sub-decoder configuring a plurality of first equivalent CMOS switches, wherein said plurality of switches in said third sub-decoder comprises a fourth switch composed by a transistor of said first polarity, said fourth switch arranged in correspondence with said second switch in said fourth sub-decoder and controlled to be conductive or non-conductive in accordance with a bit signal corresponding to the other of said P-th bit and said complementary signal of said P-th bit, among said M bits, said second switch in said fourth sub-decoder and said fourth switch in said third sub-decoder configuring a second equivalent CMOS switch, wherein said plurality of switches in said fifth sub-decoder comprises a fifth switch composed by a transistor of said second polarity and controlled to be conductive or non-conductive in accordance with a bit signal corresponding to one of a normal signal and a complementary signal of one bit signal of said Q-bits, and said plurality of switches in said third sub-decoder further comprises a sixth switch composed by a transistor of said first polarity, said sixth switch arrange in correspondence with said fifth switch in said fifth sub-decoder and controlled to be conductive or non-conductive in accordance with a bit signal corresponding to the other of said normal signal and said complementary signal of said bit signal of said one bit signal of said Q-bits among said M bits, said fifth switch in said fifth sub-decoder and said sixth switch in said third sub-decoder configuring a third equivalent CMOS switch, and wherein said at least one switch in said sixth sub-decoder comprises a seventh switch composed by a transistor of said second polarity, said seventh switch being connected to one output end among said first number of said output ends of said first sub-decoder, said seventh switch controlled to be conductive or non-conductive in accordance with a bit signal corresponding to one of a normal signal and a complementary signal of one bit signal of said K-bits, and said plurality of switches in said third sub-decoder further comprises, an eighth switch composed by a transistor of said first polarity, said eighth switch being connected to said one output end among said first number of said output ends of said first sub-decoder, said eighth switch controlled to be conductive or non-conductive in accordance with a bit signal corresponding to the other of said normal signal and said complementary signal of said one bit signal of said K-bits among said M bits, said seventh switch in said sixth sub-decoder and said eighth switch in said third sub-decoder configuring an equivalent fourth CMOS switch.

6. The level voltage selection circuit according to claim 5, wherein wiring connected between an output end of said first sub-decoder and said sixth sub-decoder includes wiring between regions of different polarity.

7. The level voltage selection circuit according to claim 1, wherein a level voltage set obtained by combining said first to third level voltage sets includes a plurality of level voltages of mutually different voltages, the number of which is N-th power of 2, wherein said first, second, and third sub-decoders constitute a tournament configuration, in which a plurality of level voltages, the number of which is 2 to (N−1)-th power, are selected in accordance with a first bit, which is the least significant bit of said N-bit digital signal, from said level voltage set, the number of which is 2 to the N-th power, a plurality of level voltages, the number of which is 2 to the (N−2)-th power, are selected from said level voltages, the number of which is 2 to the (N−1)-th power, in accordance with a second bit one bit higher than said first bit, and finally one level voltage is selected in accordance with the most significant N-th bit signal of said N-bit data signal, from two level voltages selected by a (N−1)-th bit one bit lower than said N-th bit of said N-bit data signal, wherein said third level voltage set includes a plurality of level voltages, the number of which is 2 to the (P−1)-th power, wherein said plurality of switches in said second sub-decoder comprises a plurality of first switches, each of said first switches composed by a transistor of said first polarity, each of said first switches controlled to be conductive or non-conductive in accordance with a bit signal corresponding to a normal signal or a complementary signal of each bit from a first bit, which is the least significant bit to an L-th bit among said L bits, said plurality of first switches in said second sub-decoder selecting a plurality of level voltages, the number of which is said second number, from among a plurality of level voltages of said second level voltage set, said plurality of switches in said fourth sub-decoder comprises a plurality of second switches, each of said second switches composed by a transistor of said second polarity, each of said second switches controlled to be conductive or non-conductive in accordance with a bit signal corresponding to a normal signal or a complementary signal of each bit from said first bit to said L-th bit among said P-bits, each of said second switches composed by a transistor of said second polarity and arranged in correspondence with each of said first switches in said second sub-decoder, said plurality of said second switches in said fourth sub-decoder selecting a plurality of level voltages, the number of which is 2 to the (P−L−1)-th power, from among a plurality of level voltages of said third level voltage set, the number of which is 2 to the (P−1)-th power; and a plurality of third switches, each of said third switches composed by a transistor of said second polarity, each of said third switches controlled to be conductive or non-conductive in accordance with a bit signal corresponding to a normal signal or a complementary signal of each bit from an (L+1)-th bit to a P-th bit among said P-bits, said plurality of said third switches in said fourth sub-decoder selecting a plurality of level voltages, the number of which is said third number, from among a plurality of level voltages, the number of which is 2 to the (P−L−1)-th power, a plurality of pairs of said first switches in said second sub-decoder and said second switches in said fourth sub-decoder configuring a plurality of first equivalent CMOS switches, said plurality of switches in said third sub-decoder comprises a plurality of fourth switches, each of said fourth switches composed by a transistor of said first polarity and arranged in correspondence with each of said third switches in said fourth sub-decoder, each of said fourth switches being controlled to be conductive or non-conductive in accordance with a bit signal corresponding to said normal signal or said complementary signal of each from said (L+1)-th bit to said P-th bit among said M bits, a plurality of pairs of said third switches in said fourth sub-decoder and said fourth switches in said third sub-decoder configuring a plurality of first equivalent CMOS switches, wherein said plurality of switches in said fifth sub-decoder comprises a fifth switch composed by a transistor of said second polarity and controlled to be conductive or non-conductive in accordance with a bit signal corresponding to one of a normal signal and a complementary signal of one bit signal of said Q-bits, and said plurality of switches in said third sub-decoder further comprises a sixth switch composed by a transistor of said first polarity, said sixth switch arrange in correspondence with said fifth switch in said fifth sub-decoder and controlled to be conductive or non-conductive in accordance with a bit signal corresponding to the other of said normal signal and said complementary signal of said bit signal of said Q-bits, among said M bits, said fifth switch in said fifth sub-decoder and said sixth switch in said third sub-decoder configuring a third equivalent CMOS switch, and wherein said at least one switch in said sixth sub-decoder comprises a seventh switch composed by a transistor of said second polarity, said seventh switch being connected to one output end among said first number of said output ends of said first sub-decoder, said seventh switch controlled to be conductive or non-conductive in accordance with a bit signal corresponding to one of a normal signal and a complementary signal of one bit signal of said K-bits, and said plurality of switches in said third sub-decoder further comprises, an eighth switch composed by a transistor of said first polarity, said eighth switch being connected to one output end among said first number of said output ends of said first sub-decoder, said eighth switch controlled to be conductive or non-conductive in accordance with a bit signal corresponding to the other of said normal signal and said complementary signal of said bit signal of said at least one of said K-bits, among said M bits, said seventh switch in said sixth sub-decoder and said eighth switch in said third sub-decoder configuring an equivalent fourth CMOS switch.

8. A data driver including:

the level voltage selection circuit according to claim 1; and an amplifier circuit including an output end connected to a data line, wherein said level voltage selection circuit receives a plurality of reference voltages, as said first to third level voltage sets, and selects a voltage from among said plurality of reference voltages, based on an N-bit digital signal supplied thereto to provide a voltage selected to said amplifier circuit, said amplifier circuit amplifying and outputting said voltage selected to said output end.

9. A display device comprising the data driver according to claim 8.

10. The display device according to claim 9, comprising a display element that includes one of a liquid crystal element and an organic light emitting diode element.

11. A digital to analog converter apparatus receiving a digital signal and converting said digital signal to an analog signal to output said analog signal, said digital to analog converter including the level voltage selection circuit according to claim 1.

* * * * *